US006764800B2

(12) United States Patent
Yamazaki et al.

(10) Patent No.: US 6,764,800 B2
(45) Date of Patent: Jul. 20, 2004

(54) IMAGE FORMING PROCESS, AND PHOTOSENSITIVE MEMBER EMPLOYED THEREFOR

(75) Inventors: Koji Yamazaki, Odawara (JP); Hiroyuki Kobayashi, Fuji (JP); Masaya Kawada, Mishima (JP); Tetsuya Karaki, Sunto-gun (JP); Hironori Owaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/842,041

(22) Filed: Apr. 26, 2001

(65) Prior Publication Data

US 2002/0006572 A1 Jan. 17, 2002

(30) Foreign Application Priority Data

May 12, 2000 (JP) ..... 2000-140674

(51) Int. Cl.[7] ..... G03G 13/16

(52) U.S. Cl. ..... 430/126; 430/47; 430/46; 399/302; 399/308; 399/159; 399/306; 399/303; 399/299

(58) Field of Search ..... 430/124, 47, 46; 399/302, 308, 159, 306, 303, 299

(56) References Cited

U.S. PATENT DOCUMENTS

| | | | | |
|---|---|---|---|---|
| 4,764,448 A | * | 8/1988 | Yoshitomi et al. | 430/120 |
| 4,898,798 A | * | 2/1990 | Sugata et al. | 430/58 |
| 5,187,039 A | * | 2/1993 | Meyer | 430/126 |
| 5,256,512 A | | 10/1993 | Kobayashi et al. | 430/106 |
| 5,258,811 A | | 11/1993 | Miyake et al. | 355/210 |
| 5,669,052 A | * | 9/1997 | Kusaba et al. | 399/308 |
| 5,689,768 A | | 11/1997 | Ehara et al. | 399/96 |
| 5,701,560 A | | 12/1997 | Tsujita et al. | 399/159 |
| 5,715,510 A | | 2/1998 | Kusaba et al. | 399/308 |
| 6,141,513 A | | 10/2000 | Nishiuwatoko et al. | 399/109 |

FOREIGN PATENT DOCUMENTS

| | | | |
|---|---|---|---|
| JP | 63-301960 | | 12/1988 |
| JP | 5045916 A | * | 2/1993 |
| JP | 7-77702 | | 8/1995 |
| JP | 8-160759 | | 6/1996 |
| JP | 8-211757 | | 8/1996 |
| JP | 8-320591 | | 12/1996 |
| JP | 2001-51524 | | 2/2001 |
| WO | WO-83/01127 A1 | * | 3/1983 |

* cited by examiner

*Primary Examiner*—Christopher Rodee
(74) *Attorney, Agent, or Firm*—Fitzpatrick, Cella, Harper & Scinto

(57) ABSTRACT

In an electrophotographic image process, a latent image is formed on a photosensitive drum, and a toner image is formed on the latent image. The toner image is temporarily transferred onto an intermediate image-transfer element. The photosensitive drum and the intermediate image-transfer element are brought into contact at an intended contact pressure and are rotated at a prescribed relative speed. At the contact portion, fine vibrations of the photosensitive drum and the intermediate image-transfer element, which can be caused by repeated contact and separation are prevented by controlling the contact temperature between the photosensitive member and the intermediate image-transfer element to be in the range of 15 to 60° C. A kinetic frictional deviation (a standard deviation of a kinetic frictional force) is controlled to be less than the average value of the kinetic frictional force. By suppressing the fine vibration, deviation in image transfer is prevented. In addition, toner melt adhesion and foreign matter deposition is prevented, whereby image blurring is prevented.

23 Claims, 10 Drawing Sheets

IMAGE FORMING PROCESS, AND PHOTOSENSITIVE MEMBER EMPLOYED THEREFOR

BACKGROUND OF THE INVENTION

1. Field of the Invention

The present invention relates to an image-forming process applicable to copying machines, printers, facsimile machines, and the like, and a photosensitive member employed for the image-forming process. More specifically, the present invention relates to an image-forming process applicable to copying machines, printers, facsimile machines, and the like, comprising steps of forming a toner image on a photosensitive member having on a substrate a photoconductive layer typified by a-Si, and transferring the toner image onto a transfer-receiving medium; and relates also a photosensitive member employed for the image-forming process.

2. Related Background Art

Image forming apparatuses employing an electrophotographic process are known which forms a synthetic color image by decomposing a color image information or a multicolor information into its color components, forming a latent image corresponding to the respective color components on a photosensitive member, forming a toner image on the latent image, transferring the toner image of this color component temporarily on an intermediate image-transfer element, and further transferring onto this toner image another color component toner image in superposition. The image forming apparatus employing such an intermediate image-transfer element is useful as a color image forming apparatus, a multiple color image forming apparatus, or an image forming apparatus equipped with a color image forming mechanism or a multiple color image forming mechanism since the apparatus gives color images with sufficient superposition (registration) of component color images. Color copying machines and color printers equipped with such an image forming apparatus have come to be marketed.

Another type of image forming apparatuses are known which transfers successively color-component images of color image information or of multicolor image information directly onto a recording sheet conveyed by an image-transferring belt to output a synthesized color image or multicolor image. The image forming apparatus employing such an image-transferring belt is useful as a color image forming apparatus, or a multiple color image forming apparatus. The image forming apparatus employing the image-transferring belt is also useful as an image forming apparatus for high-speed formation.

The image forming apparatuses employing an intermediate image-transfer element or an image-transferring belt are disclosed in Japanese Patent Application Laid-Open Nos. 8-320591, 8-211757, 8-160759, 2001-51524, and so forth.

As a photosensitive material, a-Si absorbs moisture on its surface under high humidity conditions, which tends to cause smudging of the toner image to result in blurring of the formed image. Smudging the toner is not the only condition, which adversely affects the quality of the image. Other conditions affecting the quality of the image include adhering matters include various foreign matters deposited onto the photosensitive material surface such as fine dust of paper usually used as the recording sheet, organic components released from the paper, and corona products generated by corona discharge at a high voltage in the apparatus. In particular, under high humidity conditions, the deposited matter lowers the resistivity of the photosensitive material, resulting in lower sharpness of the latent image and lower quality of the recorded image. To prevent the image blurring simply and effectively, usually the moisture absorption on the photosensitive material surface is prevented by employing a heater to apply electric current throughout whole days.

Such image forming apparatuses are required to save energy and to decrease industrial waste so as not to cause environmental pollution as in Blue Angel and Energy Star Program. Therefor, a method for preventing the image blurring on the a-Si photosensitive material is demanded which does not require a waiting power of the aforementioned whole-day electricity application system. Further, elongation of the lives of the members like the photosensitive member, the intermediate image-receiving member, and image transfer belt of the electrophotography apparatus is required to decrease waste.

The a-Si photosensitive material has a significantly high hardness (Vickers hardness ranging from 1500 to 2000 kg/mm$^2$), and is much less surface-abradable than other photosensitive materials such as organic photosensitive materials and selenium type photosensitive materials (Vickers hardness ranging from 50 to 150 kg/mm$^2$). Specifically the abrasion loss of the a-Si by image formation of several ten thousands of sheets is only several nanometers. The organic photosensitive member or the selenium type photosensitive member is abraded at the surface during use to produce fresh surface incessantly, whereby the adverse effect of the adhering matter is reduced, even when melt adhesion of a toner or deposition of a foreign matter occurs. In contrast, the a-Si photosensitive material, which is abraded less at the surface, is liable to cause significant adhesion of the melted toner or deposition of a foreign matter depending on the constitution. Therefore, the a-Si photosensitive material changes greatly the sildability on contacting members such as a cleaning blade by adhesion of the melted toner or deposition of the foreign matter in a small amount to cause vibration (so-called chattering vibration) of the cleaning blade or uneven distribution of the load, resulting in frequent cleaning failure.

The intermediate image-transfer element or the image-transferring belt is brought into contract with the photosensitive member with a nip contact breadth of several millimeters at a contact pressure ranging from 5 to 1000 g/cm$^2$ (0.49 to 98.1 kPa). The intermediate image-transfer element or the image-transferring belt is repeatedly attached to and detached from the copying paper sheet, which may cause fine vibration (chattering vibration). When the vibration is strong, the transferred toner image can be blurred or not to be registered to impair the image quality directly. Even when the vibration is not so strong, the energy generated by the vibration may cause toner melt adhesion, filming, adhesion of talc or paper dust onto the intermediate image-transfer element or the image-transferring belt to cause an image defect in a stripe state or a dot state, or to cause blurring of the image by high-temperature and high-humidity conditions (30° C., 80% RH or higher) on the photosensitive member surface disadvantageously. The toner melt adhesion or foreign matter deposition tends to occur especially at the contact position (nip) of the photosensitive member with the intermediate image-transfer element or the image-transferring belt.

Hitherto, such problems have been dealt with by changing the material of or the shape of the intermediate image-transfer element of the image-transferring belt, contact conditions, and stretching conditions thereof. However, a-Si has not been studied as the factor for preventing the fine vibration, toner melt adhesion, and foreign matter deposition, so that the problem has not been solved satisfactorily.

In the recent years, electrophotographic image forming apparatuses having a printer function in addition to the copying function have come to be widely used. For such apparatuses, accessories such as a feeder mechanism and a sorter mechanism are developed. With such development, continuous image formation on 4000 sheets or more of recording sheets can be practicable in one job. In such recording operation, for example, at an image formation rate of 50 sheets (A4-size, 210 mm×297 mm) per minute, the 4000 sheet (A4-size) of image formation will be continued for 80 minutes or longer by simple calculation. Such a long time of continuous operation will elevate the ambient temperature up to about 50° C. around the photosensitive member, and can elevate the temperature at the contact portion between the photosensitive member and the intermediate image-transfer element or between the photosensitive member and the image-transferring belt to be higher than that. In addition to the occurrence of the aforementioned fine vibration, the higher temperature at the contact portion can aggravate further the toner melt adhesion.

The a-Si photosensitive material has a semipermanent life. It is confirmed that the photosensitive member employed in a copying machine has a durability for image formation of three million to five million sheets. Therefore, for the purpose of material-saving, and running cost reduction, the intermediate image-transfer element or the image-transferring belt as the peripheral ancillary member employed with the a-Si photosensitive material should also have a sufficiently long life. However, the fatigue or deterioration of the intermediate image-transfer element or the image-transferring belt which is resulting from the fine vibration caused by repetition of contact with or separation from the a-Si photosensitive member is not sufficiently elucidated. Therefore, dramatic elongation of the life of the intermediate image-transfer element or the image-transferring belt has not been achieved.

SUMMARY OF THE INVENTION

The present invention has been made to solve the above-mentioned problems.

An object of the present invention is to enable output of an image of high quality by suppressing chattering vibration generated at the image formation site or between the members around the image formation site, and by preventing transfer deviation, toner melt adhesion, paper dust deposition, or the like.

Another other object of the present invention is to provide an image forming process in which the deterioration of the intermediate image-transfer element or the image-transferring belt is retarded to lengthen the life thereof.

Still another object of the present invention is to provide an image forming process which prevents image transfer deviation which is caused by repeated contact with, or separation from the a-Si photosensitive member, of the intermediate image-transfer element or the image-transferring belt; and prevents image blurring which is caused by toner melt adhesion or foreign matter deposition like paper dust deposition onto the photosensitive member surface.

A further object of the present invention is to provide an image forming process which enables high-speed driving of the intermediate image-transfer element or the image-transferring belt and lengthens the life thereof; and which achieves readily a higher freedom degree for selection of the construction material and the constitution of the intermediate image-transfer element or the image-transferring belt.

A still further object of the present invention is to provide an image forming process which reduces the environmental pollution by making unnecessary the heating of the photosensitive member to decrease the waiting electric power, and by other measures.

According to an aspect of the present invention, there is provided an image forming process for an electrophotographic system employing an image forming apparatus equipped with a photosensitive member having a photoconductive layer composed of a silicon-based non-monocrystalline material and a surface layer composed of a non-monocrystalline material formed successively on a peripheral face of a cylindrical electroconductive substrate, and a cylindrical intermediate image-transfer element in contact with the photosensitive member at the surface thereof, and rotating the photosensitive member and the intermediate image-transfer element at a prescribed relative speed; the process comprising an electrifying step of electrifying a surface of the photosensitive member, a latent image-forming step of forming an electrostatic latent image by protection of light onto the surface electrified in the electrifying step, a developing step for forming a toner image by deposition of a toner on the surface carrying the electrostatic latent image formed by the latent image-forming step, and an image transferring step for transferring the toner image formed in the developing step onto the intermediate image-transfer element; and repeating the electrifying step, the latent image-forming step, the developing step, and the transferring step plural times to form plural toner images in superposition on the intermediate image-transfer element, and transferring the toner images formed in superposition on the intermediate image-transfer element onto a recording sheet:

wherein the photosensitive member and the intermediate image-transfer element are brought into contact at a contact temperature ranging from 15° C. to 60° C. at an intended relative speed of the photosensitive member to the intermediate image-transfer element to give a kinetic frictional deviation (a standard deviation of kinetic frictional force) less than the average value of the kinetic frictional force.

According to another aspect of the present invention, there is provided an image forming process for an electrophotographic system employing an image forming apparatus equipped with plural photosensitive members having respectively a photoconductive layer composed of a silicon-based non-monocrystalline material and a surface layer composed of a non-monocrystalline material formed on a peripheral face of a cylindrical electroconductive substrate, and an image-transferring belt for holding and delivering a recording sheet with successive contact with the surfaces of the plural photosensitive members, and moving the photosensitive member and the recording sheet prescribed relative speed;

the process comprising an electrifying step of electrifying a surface of one of the photosensitive members, a latent image-forming step of forming an electrostatic latent image by projection of light onto the surface electrified in the electrifying step, a developing step for forming a toner image by deposition of a toner on the surface carrying the electrostatic latent image formed by the latent image-forming step, and an image transferring step for transferring the toner image formed in the developing step onto the recording sheet; and repeating the electrifying step, the latent image-forming step, the developing step, and the transferring step for the respective plural photosensitive members to form plural toner images in superposition on the recording sheet:

wherein the photosensitive member and the recording sheet are brought into contact at a contact temperature ranging from 15° C. to 60° C. at an intended relative speed of the photosensitive member to the recording sheet to give a kinetic frictional deviation (a standard deviation of kinetic frictional force) less than the average value of the kinetic frictional force.

The image forming process of the present invention prevents fine vibration of the photosensitive drum 1 and the intermediate image-transfer element 20, which can be caused by repeated contact and separation of the photosensitive member and the intermediate image-transfer element. Thereby, deviation in image transfer caused by the fine vibration can be prevented. Further, toner melt adhesion and foreign matter deposition onto the photosensitive member surface is prevented, whereby image blurring is prevented. Further, deterioration of the intermediate image-transfer element caused by the fine vibration is prevented. The temperature of the contact portion, and the kinetic frictional deviation coefficient can be controlled within the aforementioned ranges, for example by selecting the material of the photosensitive member or the intermediate image-transfer element.

Further, the fine vibration can effectively be suppressed by controlling the kinetic frictional deviation coefficient to be not higher than 0.1, where the kinetic frictional deviation coefficient is a rate of change of the ratio of the kinetic frictional deviation per unit length in length direction of the contact face to the contacting linear pressure, and the contacting linear pressure is defined as the force applied to contact the photosensitive member with the intermediate image-transfer element per unit length in the length direction of the contact-face.

The fine vibration can also effectively be suppressed by controlling the range of variation of the kinetic frictional deviation coefficient to be not more than 0.02 for change of the contact temperature of the photosensitive member with the intermediate image-transfer element from 15° C. to 60° C., so that the kinetic frictional deviation coefficient may not become larger regardless of temperature variation at the contact portion.

The fine vibration can also effectively be suppressed by providing a surface layer composed of a non-monocrystalline material based on silicon and/or carbon, and controlling the range of variation of the kinetic frictional deviation coefficient to be not more than 0.01 for change of the contact temperature of the photosensitive member with the intermediate image-transfer element from 15° C. to 60°C.

The properties of the photosensitive member in the latent image formation, the toner image formation, and the cleaning can be made stable without significant influence of environment by controlling the rate of change of the dark portion-electrifying ability to temperature change to be in the range within ±2%/° C., whereby the above operation can be conducted satisfactorily. For controlling the rate of change of the dark portion-electrifying ability to temperature change to be in the range within ±2%/° C., the characteristic energy in exponential energy distribution of a tail level of a valence band is preferably controlled to be in the range from 50 to 70 meV. The characteristic energy can be controlled to be in the above range, for example by selecting the material of the photosensitive layer of the photosensitive member, or selecting the film formation conditions such as the film formation speed.

The filming or the toner melt adhesion can be prevented by controlling the center-line average roughness of the surface of the photosensitive member to be in the range from 0.01 to 0.9 $\mu$m, and the average inclination $\Delta a$ to be in the range from 0.001 to 0.06. The center-line average roughness of the surface of the photosensitive member, and the average inclination can be controlled to be in the above ranges, for example by selecting the material of the photosensitive layer of the photosensitive member, or selecting the filming formation conditions such as the filming formation speed.

The present invention is also applicable, by employing the aforementioned contact conditions of the photosensitive member with the intermediate image-transfer element to the contact conditions of the photosensitive member and the image-transferring belt, to the image forming process for an electrophotographic system employing an image forming apparatus equipped with plural photosensitive members having respectively a photoconductive layer composed of a silicon-based non-monocrystalline material and a surface layer composed of a non-monocrystalline material formed successively on a peripheral face of a cylindrical electroconductive substrate, and an image-transferring belt for holding and delivering a recording sheet with successive contact with the surfaces of the plural photosensitive members, and moving the photosensitive member and the recording sheet prescribed relative speed; the process comprising an electrifying step of electrifying a surface of one of the photosensitive members, a latent image-fanning step of forming an electrostatic latent image by projection of light onto the surface electrified in the electrifying step, a developing step for forming a toner image by deposition of a toner on the surface carrying the electrostatic latent image fanned by the latent image-fanning step, and an image transferring step for transferring the toner image fanned in the developing step onto the recording sheet; and repeating the electrifying step, the latent image-farming step, the developing step, and the transferring step for the respective plural photosensitive members to form plural toner images in superposition on the recording sheet.

The photosensitive member of the present invention is employed in an electrophotographic image forming apparatus for forming an electrostatic latent image by uniform electrification of the surface thereof and projection of imaging light, depositing a toner on the electrostatic latent image to form a toner image, and transferring the toner image onto an image-receiving member. This photosensitive member has a photoconductive layer composed of a silicon-based non-monocrystalline material and a surface layer composed of a non-monocrystalline material, and has a surface which gives a kinetic frictional deviation (a standard deviation of kinetic frictional force) less than the average value of the kinetic frictional force between the photosensitive member and the image-receiving member when the photosensitive member and the image-receiving member is brought into contact at a contact temperature ranging from 15° C. to 60° C. at an intended relative speed of the photosensitive member to the image-receiving member.

The image forming apparatus of the present invention comprises a photosensitive member having a photoconductive layer composed of a silicone-based non-monocrystalline material and a surface layer composed of a non-monocrystalline material formed on a peripheral surface of a cylindrical electroconductive substrate, an electrifier for electrifying the surface of the photosensitive member, and imaging light projecting means for projecting imaging light onto the electrified surface to form a latent image thereon, a developing means for applying a toner onto the surface having the electrostatic latent image to form a toner image, and an intermediate image-transfer element in a cylinder shape placed to be in contact with the photosensitive member at the surfaces, wherein the image forming apparatus conducts image formation according to the image forming process as set forth above.

Another embodiment of the image forming apparatus of the present invention comprises plural photosensitive members having respectively a photoconductive layer composed of a silicon-based non-monocrystalline material and a surface layer composed of a non-monocrystalline material formed on a peripheral surface of a cylindrical electroconductive substrate, electrifiers for electrifying the surface of the photosensitive member, imaging light projecting means for projecting imaging light onto the electrified surface to form a latent image thereon, developing means for applying a toner onto the surface having the electrostatic latent image to form a toner image, and a image-transferring belt for holding and delivering a recording sheet with successive contact with the surfaces of the plural photosensitive members, wherein the image forming apparatus conducts image formation according to the image forming process as set forth above.

BRIEF DESCRIPTION OF THE DRAWINGS

FIG. 5 is a graph showing an example of a roughness curve for explaining the method for deriving the average inclination Δa.

FIG. 8A is a graph showing a change of the frictional force with lapse of time. FIG. 8B is a graph showing dependency of the frictional force on the contact pressure.

DETAILED DESCRIPTION OF THE PREFERRED EMBODIMENTS

The present invention is explained in detail by reference to drawings as necessary. Firstly the entire constitution of a usual electrophotographic image forming apparatus is explained.

(Electrophotographic Apparatus Employing Intermediate Image-Transfer Element)

Figure 1:
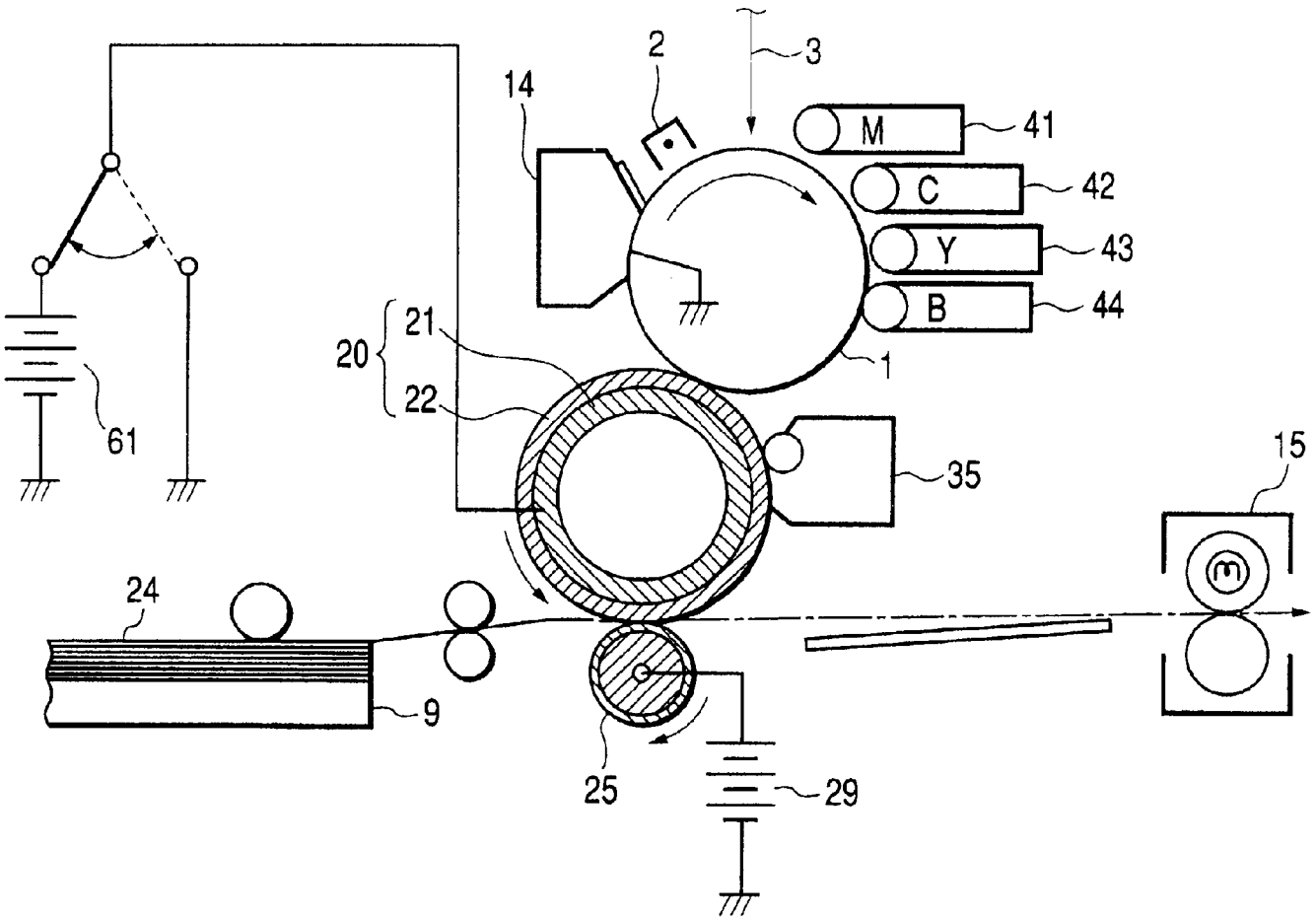
FIG. 1 shows schematically a constitution of an example of a color image forming apparatus having an intermediate image-transfer element for an electrophotographic process.

FIG. 1 shows schematically an example of a color image forming apparatus (copying machine or laser beam printer) having an intermediate image-transfer element 20, which is an elastic roller having a medium level of resistance, and employing an electrophotographic process.

This image forming apparatus has a photosensitive drum 1 of a rotating drum type which is the first image-holding member, and is constituted of an electrophotographic sensitive member which is used in repetition. On the surface of this photosensitive drum, an electrostatic latent image is formed, and then a toner is allowed to be deposited onto the electrostatic latent image to form a toner image. Around photosensitive drum 1, there are disposed a primary electrifier 2 for electrically charging the surface of photosensitive drum 1 at a prescribed polarity and potential uniformly, and an imaging light projector not shown in the drawing for projecting imaging light 3 onto the electrified surface of photosensitive drum 1. There are also disposed developing devices: a first developing device 41 for depositing a magenta toner M, a second developing device 42 for depositing a cyan toner C, a third developing device 43 for depositing a yellow toner Y, and a fourth developing device 44 for depositing a black toner B. Further there are disposed a photosensitive member cleaner 14 for cleaning the surface of photosensitive drum 1 after transfer of the toner image onto an intermediate image-transfer element 20.

Intermediate image-transfer element 20 is placed so as to be rotatable by contact with photosensitive drum 1, having core metal 21 in a pipe shape, and elastic layer 22 fanned on the peripheral face of core metal 21. To core metal 21, bias power source 61 is connected which applies a primary transfer bias for transferring the toner image formed on photosensitive drum 1 onto intermediate image-transfer element 20. By the side of intermediate image-transfer element 20, transfer roller 25 is placed for transferring further the transferred toner image kept on intermediate image-transfer element 20 onto recording sheet 24, the transfer roller being held by an axis parallel with the rotation axis of intermediate image-transfer element 20 to be brought into contact with the bottom face of intermediate image-transfer element 20. Transfer member cleaner 35 is disposed for cleaning the remaining toner on the surface of intermediate image-transfer element 20 after transfer of the toner image from intermediate image-transfer element 20 onto recording sheet 24. To transfer roller 25, bias power source 29 is connected to apply a secondary transfer bias for transferring the toner image from intermediate image-transfer element 20 to recording sheet 24.

This image forming apparatus is equipped with sheet-feeding cassette 9 for storing recording sheets 24 for image recording, and a delivery mechanism for feeding recording sheet 24 from sheet-feeding cassette 9 through the contact nip between transfer member 20 and transfer roller 25. Fixing device 15 is disposed on the delivery path of recording sheet 24 for fixing the transferred toner image on the recording sheet 24.

Primary electrifier 2 may be a corona discharger, or the like. As the imaging light projector, there may be employed an optical system for a color-separation and imaging light projection of a colored original, or a scanning light exposure system having a laser scanner for outputting a laser beam modulated in correspondence with time-series electric digital signals of image information. Bias power source 61 applies a voltage of the polarity (+) reverse to that of the toner, for example ranging from +2 kV to +5 kV.

The operation of this image forming apparatus is explained below.

As shown in FIG. 1, photosensitive drum 1 is driven to rotate clockwise at a prescribed peripheral speed (process speed). Intermediate image-transfer element 20 is driven counterclockwise at the same peripheral speed as photosensitive drum 1. The rotation may be conducted at desired rates. Intermediate image-transfer element 20 and photosensitive drum 1 may be driven at a desired relative speed with slight speed difference which does not adversely affect the image formation. Such slight difference of the rotation speed is considered to be the same speed.

Photosensitive drum 1 is electrified in the process of rotation at a prescribed polarity and potential by primary electrifier 2. Then, imaging light 3 is projected to form an electrostatic latent image corresponding to a first color component image of the intended color image (e.g., a magenta component image) on the surface of photosensitive drum 1. The electrostatic latent image is developed with magenta toner M as the first color by first developing device 41. In this step, second developing device 42, third developing device 43, and fourth development device 44 are kept turned off not to act on photosensitive drum 1 and not to affect the first color magenta toner image.

The magenta toner image of the first color thus formed and held on photosensitive drum 1 is subsequently transferred temporarily onto the peripheral face of intermediate image-transfer element 20 during passage through the nip between photosensitive drum 1 and intermediate image-transfer element 20 by action of the electric field generated by a primary transfer bias applied from bias power source 61.

After transfer of the magenta toner image as the first color onto intermediate image-transfer element 20, the surface of photosensitive drum 1 is cleaned by photosensitive member cleaner 14. Then, on the cleaned surface of photosensitive drum 1, a toner image of a second color (e.g., cyan toner image) is formed in the same manner as the first color toner image. This second color toner image is transferred in superposition onto the surface of intermediate image-transfer element 20 holing the first color toner image. Further in the same manner, a third color toner image (e.g., yellow toner image), and the fourth color toner image (e.g., black toner image) are transferred in the same manner successively in superposition onto intermediate image-transfer element 20 to form a synthetic color toner image corresponding to the intended color image.

Thereafter, hereafter, recording sheet 24 is delivered to the contact nip between intermediate image-transfer element 20 and transfer roller 25 at prescribed timing. Then, transfer roller 25 is brought into contact with intermediate image-transfer element 20, and thereto the secondary transfer bias is applied from bias power source 29 to transfer roller 20. Thereby, the synthesized color toner image formed in superposition on intermediate image-transfer element 20 is transferred onto recording sheet 24 as the second image bearing member. After transfer of the toner image onto recording sheet 24, the remaining toner on intermediate image-transfer element 20 is cleaned by intermediate image-transfer element cleaner 35. Recording sheet 24 having received the transferred toner image is delivered to fixing device 15, and there the toner image is thermally fixed on recording sheet 24.

During the successive transfer of the first to fourth color toner from photosensitive drum 1 to intermediate image-transfer element 20, transfer roller 25 and intermediate image-transfer element 35 may be kept apart from intermediate image-transfer element 20 in operation of this image forming apparatus.

The color image forming apparatus employing such an intermediate image-transfer element according to an electrophotographic method has various advantages in comparison with the conventional one, for example disclosed in Japanese Patent Application Laid-Open No. 63-301960, in which a recording sheet is fixed by sticking or adhesion onto a transfer drum and plural color images are repeatedly transferred in superposition from an image holding member, in the following points. The advantages are as explained below.

Firstly, color deviation is less. In other words, color registration is more precise superposition of the color images.

Various kinds of recording sheets can be used, since the recording sheet is not worked or controlled (e.g., not held by a gripper, not sucked, or not curved) for transferring the toner image from intermediate image-transfer element 20 onto recording sheet 24 as shown in FIG. 1. For example, various thicknesses of paper sheets ranging from thin paper sheets (basis weight: 40 g/m$^2$) to thick paper sheets (basis weight: 200 g/m$^9$) can be selected for use as recording sheet 24. Further, recording sheet 24 is not limited in breadth and length. Envelopes, post cards, label paper pieces, and the like can be used as recording sheets 24.

Intermediate image-transfer element 20 may be constructed from materials of high rigidity. Thereby, dent formation, deformation, distortion, or the like by repeated use is prevented to keep the dimensional accuracy, and the frequency of exchange of the intermediate image-transfer element 20 is decreased.

As described above, the image forming apparatus employing intermediate image-transfer element 20 has many advantages.

(Electrophotographic Apparatus Employing Image-Transferring Belt)

Figure 2:
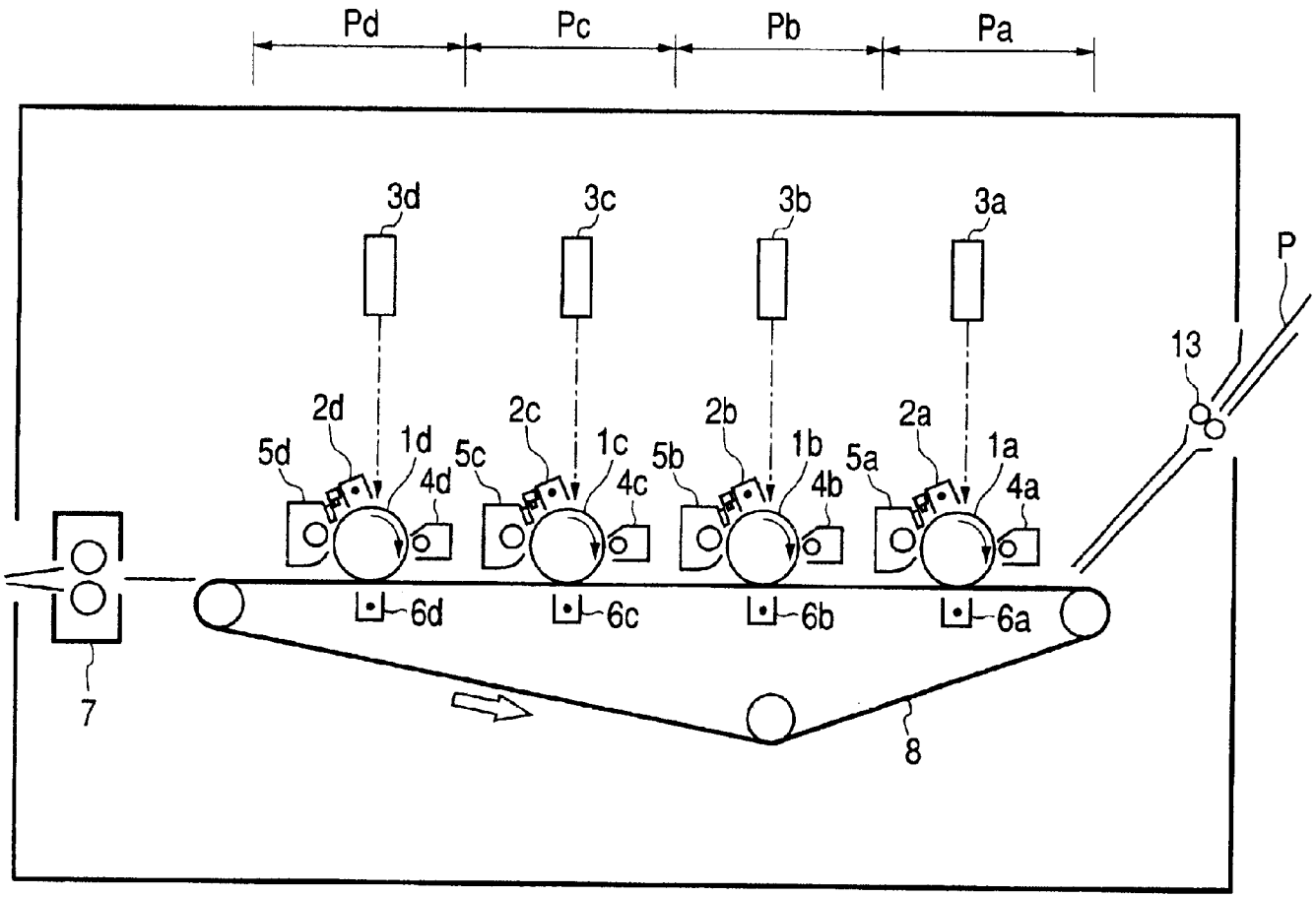
FIG. 2 shows schematically a constitution of an example of a color image forming apparatus having an image-transferring belt for an electrophotographic process.

As another embodiment, an example of the color image forming apparatus of electrophotography type is explained briefly which has an image-transferring belt 8 and the image transfer onto a recording sheet is conducted on image-transferring belt 8, by reference to FIG. 2.

This color image forming apparatus has four image formation sections of first to fourth (Pa, Pb, Pc, and Pd) arranged in series, for example, for forming respectively a yellow, magenta, cyan, or black visible image (toner image). In this color image forming apparatus, recording sheet P is fed from a sheet feeding section through register roller 13 onto image-transferring belt 8. With the movement of this belt 8 in the arrow direction in FIG. 2, recording sheet P is allowed to pass successively through image formation regions in the respective image formation sections Pa to Pd. Thereby, plural colors of toner images are superposed on recording sheet P to form a color image.

The respective image formation sections Pa to Pd are equipped with photosensitive drums 1*a*, 1*b*, 1*c*, and 1*d* to hold a toner image of the respective colors. Around the respective photosensitive drums 1*a*, 1*b*, 1*c*, and 1*d*, there are disposed primary electrifier 2*a*, 2*b*, 2*c*, or 2*d*; imaging light projector 3*a*, 3*b*, 3*c*, or 3*d*; developing device 4*a*, 4*b*, 4*c*, or 4*d*; cleaner 5*a*, 5*b*, 5*c*, or 5*d*; and so forth.

In this embodiment, endless image-transferring belt 8 is held stretched by plural rollers in a conventional manner to support and pass recording sheet P under photosensitive drums 1*a* to 1*d* in image formation sections Pa to Pd. Electrifying means 6*a*, 6*b*, 6*c*, and 6*d* for giving transfer charge are disposed respectively under photosensitive drums 1*a*, 1*b*, 1*c*, and 1*d* in opposition thereto in the region surrounded by image-transferring belt 8. In FIG. 2, sheet feeding assembly is equipped on the right side, and fixing device 7 is equipped on the opposite side, namely on the left side. Between the sheet feeding assembly and image-transferring belt 8, a pair of register rollers 13 are equipped for feeding recording sheet P at a prescribed timing.

The operation of this image forming apparatus is explained below.

In FIG. 2, as shown by arrow marks, the photosensitive drums 1*a* to 1*d* are rotated clockwise, and image-transferring belt 8 is circulated counterclockwise. Photosensitive drums 1*a* to 1*d* and image-transferring belt 8 are driven at prescribed speeds, so that their relative speeds are kept constant in principle. Naturally, a slight speed variation which does not adversely affect the image formation is considered to be constant in the relative speed, similarly as in the case of the intermediate image-transfer member described above.

In the first image formation section Pa, the surface of photosensitive drum 1*a* is electrified uniformly by primary electrifier 2*a*. An image of one color component obtained by scanning the image information of that color component, for example a yellow color component, of an original image is projected onto the electrified surface by a laser beam or a like means to form an electrostatic latent image. On this electrostatic latent image, a yellow toner is allowed to deposit by developing device 4*a* to form a yellow visible image.

On the other hand, recording sheet P is sent out from the sheet feeding assembly, and is temporarily stopped when it is just caught at the front tip by register roller 13. Then, recording sheet P is sent out in accordance with the timing of image formation in the first image formation section Pa onto image-transferring belt 8.

Recording sheet P is supported and delivered by image-transferring belt 8 to the image transfer region under photosensitive drum 1*a* in first image formation section Pa, where the yellow visible image formed on photosensitive drum 1*a* is transferred onto recording sheet P by transfer-electrifying means 6*a*.

During the transfer of the yellow toner image onto recording sheet P, an electrostatic latent image of a magenta color component, for example, is formed in the second image formation section Pb. This latent image is developed by developing device 4*b* as a magenta toner image. This formation of the magenta toner image is conducted by taking the timing to move the magenta toner image to the transfer region when the recording sheet P has just been delivered into the transfer region under photosensitive drum 1*b* in second image formation section Pb. In such a manner the magenta toner image is transferred in superposition on the yellow toner image on recording sheet P by transfer-electrifying means 6*b*.

Thereafter, color toner images, for example, of cyan and black are successively formed in third and fourth image formation sections Pc, Pd in the same manner as in first and second image formation sections Pa, Pb. The color toner images are successively transferred in superposition onto recording sheet P delivered by image-transferring belt 8.

After completion of the image transfer, the remaining toners are removed from the surfaces of photosensitive drums 1*a* to 1*d* in image formation sections Pa to Pd to be ready for the subsequent latent image formation. Recording sheet P, after completion of the superposed multiple transfer process, is allowed to leave the image-transferring belt 8 and is sent to fixing device 7. There, the multiple transferred toner image is fixed in one step to obtain the intended full-color image.

(a-Si Photosensitive Member)

A usual photosensitive member 300 for electrophotographic image forming apparatus is explained by reference to FIG. 3, which is a schematic sectional view.

Figure 3:
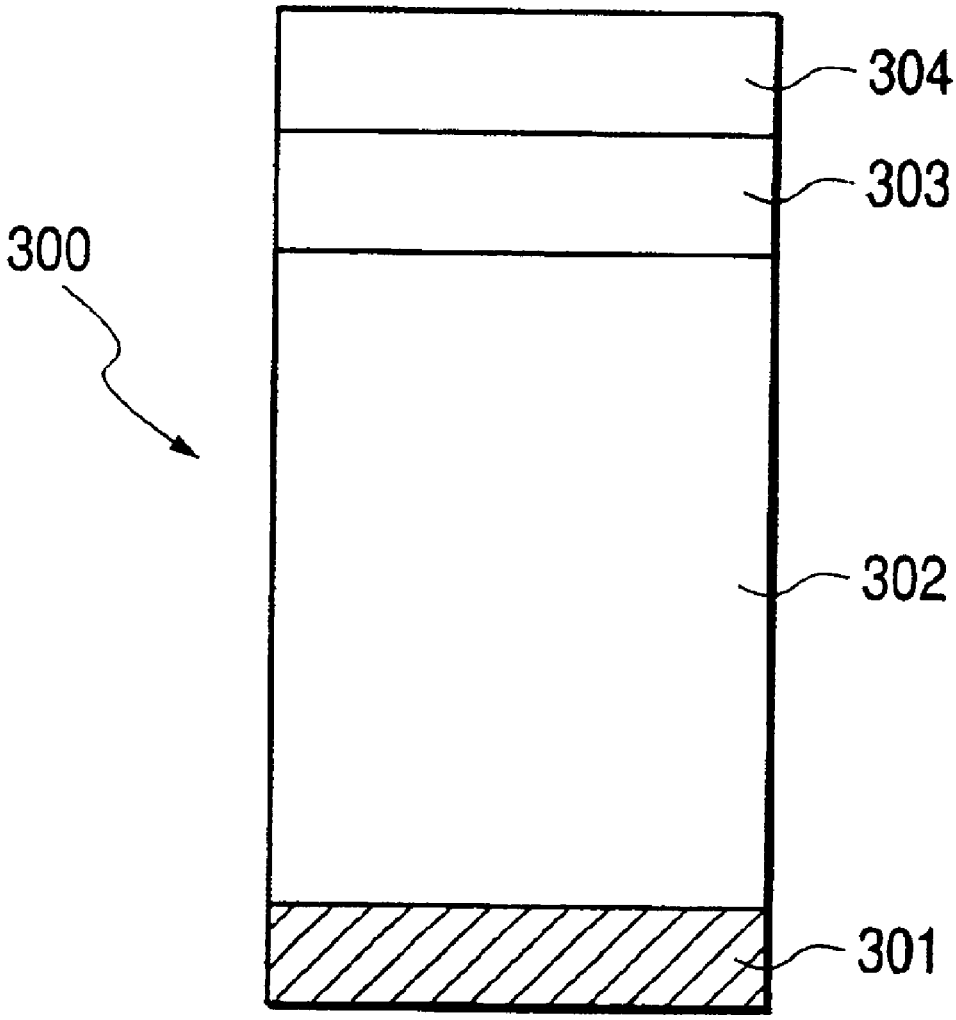
FIG. 3 is a schematic sectional view of an example of a photosensitive member.

FIG. 3 shows a partial sectional view of a surface portion of a cylindrical photosensitive member. This photosensitive member 300 has substrate 301 for the photosensitive material, and photosensitive layer 302 composed of a-Si:H,X (noncrystalline material constituted of silicon atoms as the base material and containing hydrogen or halogen). On photosensitive layer 302, a layer 303 composed of a-Si:H,X or a-SiC:H,X (non-monocrystalline material constituted of silicon atoms and carbon atoms as the base material and containing hydrogen or halogen) is formed as an intermediate layer or a second surface layer as necessary. Further, surface layer 304 composed of a-SiC:H,X or a-C:H,X (noncrystalline material constituted of carbon atoms as the base material and containing hydrogen or halogen) is formed as the outermost peripheral face.

Photosensitive member 300 employing a-Si:H for an image forming apparatus is produced generally through steps of heating electroconductive substrate 301 up to 50–400° C., and forming a photoconductive layer composed of a-Si on substrate 301 by a film formation process such as vacuum deposition, sputtering, ion-plating, thermal CVD (chemical vapor deposition), photo-assisted CVD, and plasma CVD (hereinafter "PCVD"). Of these film formation processes, suitable is the PCVD process which decomposes a source gas by DC glow discharge, high-frequency, or microwave to deposit a deposition product of the source gas onto substrate 301 to form an a-Si deposition film.

(Method for Production of Photosensitive Member)

Figure 4:
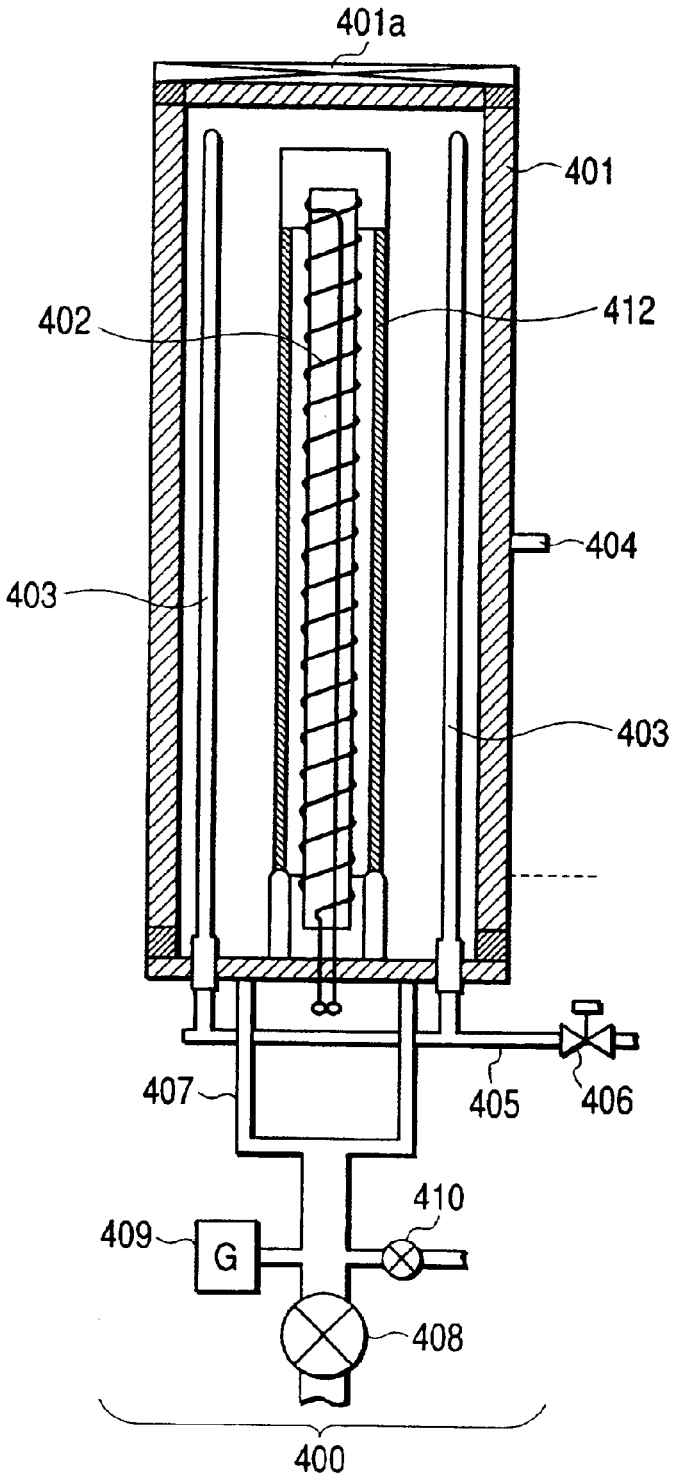
FIG. 4 is a schematic sectional view of an example of an apparatus for manufacturing a photosensitive member.

In the present invention, a-Si photosensitive member is employed which has a-Si photosensitive layer formed by high frequency plasma CVD (PCVD). FIG. 4 illustrates schematically the apparatus for production of the photosensitive member employed in the present invention. This apparatus is a usual PCVD apparatus for production of a photosensitive member for electrophotography. This PCVD apparatus comprises a deposition assembly 400, and a source gas feeding assembly and an evacuation assembly, both not shown in the drawing.

Deposition assembly 400 has vertical reaction vessel 401, a vacuum vessel. Protrusion 404 is provided on the side wall of reaction vessel 401 for application of high-frequency electric power. Plural gas introduction pipes 403 extending vertically are provided inside along the side wall of reaction vessel 401. Gas introduction pipes 403 have many small holes on the side walls along the length direction. Heater 402 is provided in a spiral form vertically at the center of reaction vessel 401. At the tope of reaction vessel 401, a openable cap 401*a* is provided for insertion of cylindrical substrate 412 as the base of photosensitive drum 1 into reaction vessel 401. Substrate 412 is placed so as to enclose heater 402 inside.

Beneath the reaction vessel 401, source gas feed pipe 405 is provided which is connected to source gas introducing pipe 403 and connected through feed valve 406 to a feeding assembly not shown in the drawing. Further beneath reaction vessel 401, evacuation pipe 407 is provided which is connected through main evacuation pipe 408 to an evacuation assembly (vacuum pump). Vacuum gauge 409 and auxiliary evacuation valve 410 are connected to evacuation valve 407.

The process for formation of a-Si photosensitive layer by means of this PCVD apparatus is explained below.

Firstly, substrate 412 as the base of the photosensitive drum is placed in reaction vessel 401. The reaction vessel is closed with cap 401*a*, and is evacuated to a prescribed pressure or lower by an evacuation assembly which is not shown in the drawing. With the evacuation continued, substrate 412 is heated from inside by heater 402 to keep substrate 412 at a prescribed temperature ranging from 20° C. to 450° C. With substrate 412 kept at the prescribed temperature, a prescribed source gas or gases corresponding to the intended photosensitive layer are introduced through introduction pipe 403 into reaction vessel 401 at a flow rate controlled respectively by a flow controller (not shown in the drawing) for the respective source gas introduction systems. The introduced gas is allowed to fill reaction vessel 401 and is evacuated through evacuation pipe 407 to the outside of vessel 401 to keep the inside pressure of reaction vessel 401 at the prescribed pressure.

After confirming the steady state of the source gases filled in reaction vessel 401 and confirming the pressure thereof in reaction vessel 401 by vacuum gauge 409, a high-frequency power is applied into reaction vessel 401 at a prescribed power level from a high-frequency power source not shown in the drawing (e.g., RF band region of frequency 13.56 MHz, or VHF band region of frequency 50 to 150 MHz) to generate glow discharge in reaction vessel 401. The energy of this glow discharge decomposes the components of the source gases to form plasma ions, and the source gases in the plasma state is deposited on the surface of substrate 412 to form an a-Si deposition layer mainly composed of silicon.

The properties of a-Si deposition layer can be varied by controlling the parameters such as the kinds of the source gases, the introduction rate of the gases, the ratio of the introduced gases, the pressure in reaction vessel 401, the temperature of substrate 412, the applied electric power, and thickness of the deposition film. Thus the properties of the photosensitive member in the electrophotographic process can be controlled: specifically, properties such as the electric properties, the surface energy, the surface shape of the surface layer of the photosensitive member, and so forth. The surface shape of the surface layer of the photosensitive member can be changed by an auxiliary method such as change of the surface shape of substrate 412. The distribution of the properties of the a-Si deposition layer formed on substrate 412 along the length direction of substrate 412 can be adjusted as desired by controlling the distribution of the flow rate of the source gases through fine holes formed along the length direction of the source gas introduction pipes 403, the flow rate of the discharged gas from the evacuation pipe, electric discharge energy, and so forth.

When the a-Si deposition layer on the surface of substrate 412 has grown to have an intended thickness, the application of the high-frequency power is stopped, and gas feed valve 406 is closed to stop introduction of the source gases into reaction vessel 401, thus completing formation of one layer of a-Si deposition layer. The operation is repeated similarly several times to obtain an a-Si photosensitive member having a multiple layer structure. In such a manner, a photosensitive drum is produced which has an a-Si photosensitive layer of a multiple layer structure on the surface of substrate 412.

The surface layer 304 of photosensitive member 300 shown in FIG. 3 was formed through the above process to have the surface having a center-line average roughness (Ra) ranging from 0.01 $\mu$m to 0.9 $\mu$m, and an average surface inclination ($\Delta a$) ranging from 0.001 to 0.06.

Figure 5:
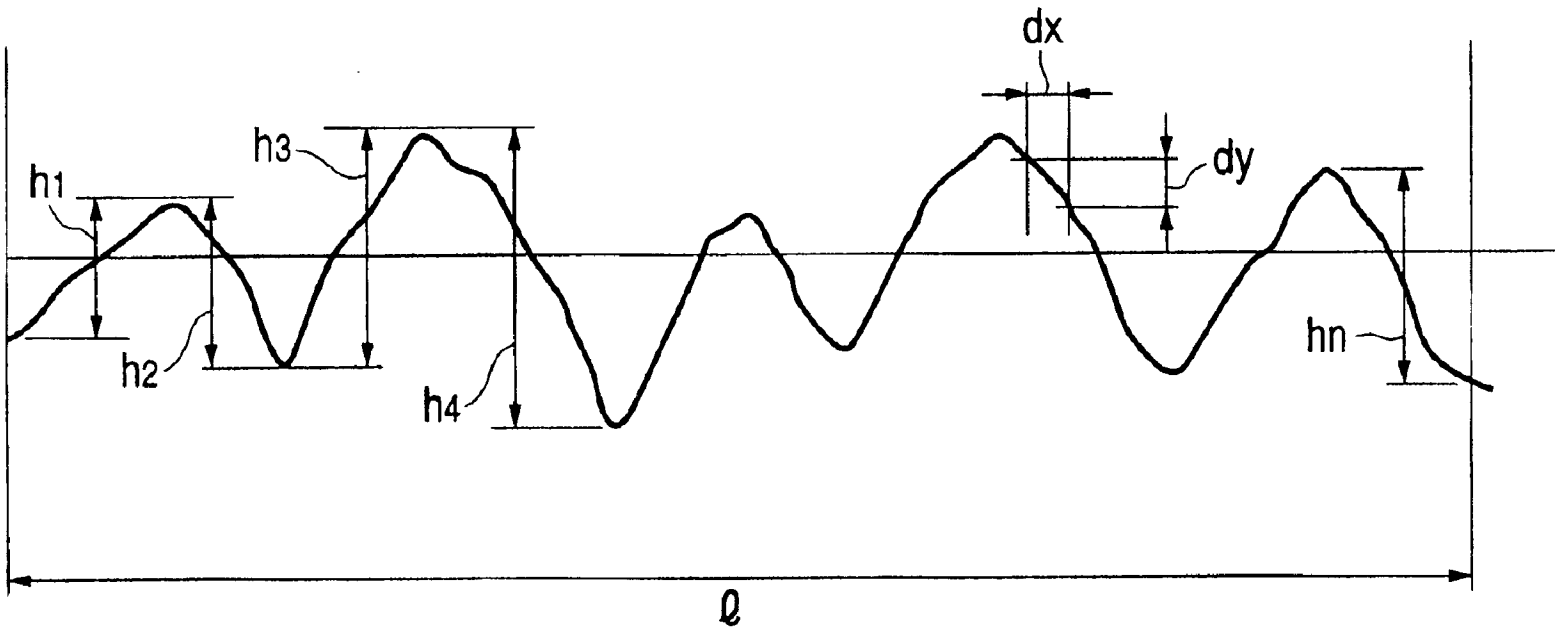

In the present invention, the average inclination $\Delta a$ was measured with a surface roughness tester SE-3300 (trade name, manufactured by Kosaka Kenkyusho K.K.) by calculation according to the definition of the average inclination described in Handling Manual of this tester: Chapter 8, "Definition of terminologies and parameters for surface roughness", Paragraphs 8–12. Specifically, the average inclination $\Delta a$ of the roughness curve having a length "l", as shown in FIG. 5, is calculated according to Equation 4 below.

$$\Delta a = \frac{1}{l}\int_0^l \left|\frac{dy}{dx}\right| dx = \left(\frac{h_1 + h_2 + h_3 + \ldots + h_n}{l}\right) \qquad \text{(Equation 4)}$$

The center-line average roughness Ra in the present invention was measured by the surface roughness tester SE-3300 under the conditions of cut-off $\lambda c$ of 0.25 mm, and evaluation length of 1.25 mm. Ra of a roughness curve f(x) is calculated according to the following equation:

$$Ra = \frac{1}{l}\int_0^l |f(x)|dx$$

where f(x) is a roughness curve and l is a length of the curve in accordance with JIS B0601-1994.

The aforementioned intended surface shape was attained by adjusting mainly the formation conditions of photosensitive layer 302 and secondarily adjusting the surface shape of substrate 301. The adjusted conditions include specifically the deposition speed, the electric discharge power, the compositions of the source gases, the kind of the diluent gas, and so forth.

The image forming apparatus of the present invention employs intermediate image-transfer element 20 or image-transferring belt 8, and an a-Si photosensitive member, and is characterized mainly in that the constitution around the contact portion between the photosensitive member and intermediate image-transfer element 20 or image-transferring belt 8 and the contact state thereof are adjusted suitably. Therefore, results of the investigation on the constitution around the contact portion and the contact state will be described by reference to Examples 1–4.

EXPERIMENTAL EXAMPLE 1

(Kinetic Frictional Force and a Standard Deviation Coefficient of the Kinetic Friction)

Figure 6:
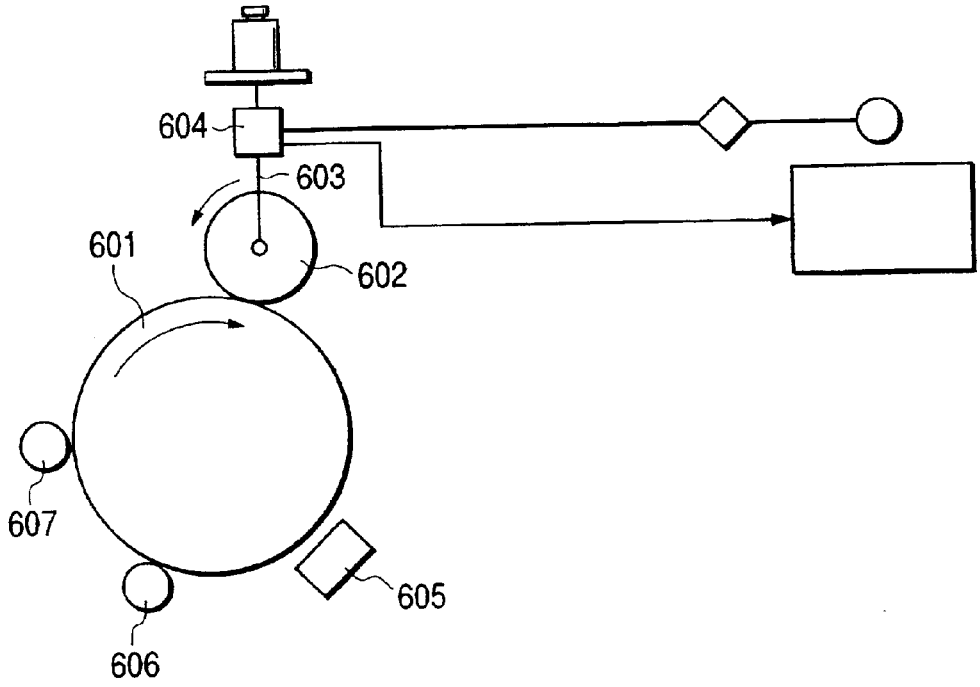
FIG. 6 is a schematic view of a friction testing apparatus for evaluating friction between the photosensitive member and the intermediate image-transfer element.
Figure 7:
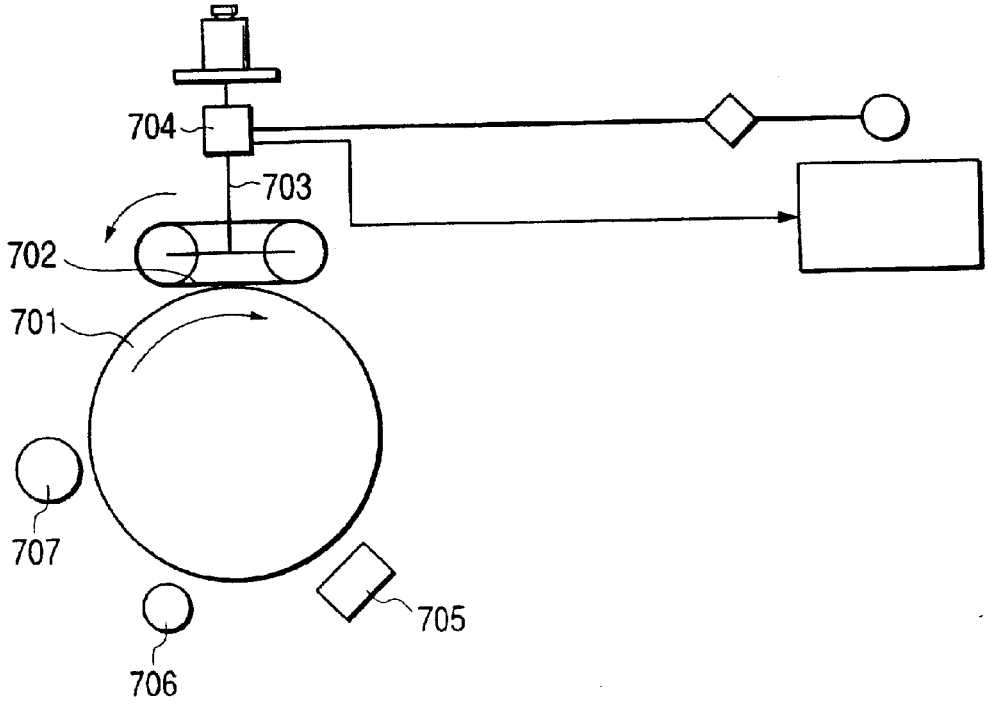
FIG. 7 is a schematic view of a friction testing apparatus for evaluating friction between the photosensitive member and the image-transferring belt.

First, a method for measuring a standard deviation coefficient of the kinetic friction, which is one of elements to designate a contact state of the present invention, will be described below. FIGS. 6 and 7 show schematic block diagrams of a friction evaluation apparatus.

FIG. 6 shows the friction evaluation apparatus located between a photosensitive element 601 and an intermediate transferring element 602. The photosensitive element 601 is rotatively supported around a horizontal shaft, around which an electrifier 605, an exposing system 606, and a developing unit 607 are installed in proper positions, respectively. The intermediate transferring element 602 is supported by a holder 603 to be rotatable around the horizontal shaft.

The holder 603 is adjusted by a balance arm to contact horizontally to the photosensitive element 601 in the state where a load has not been applied. The holder 603 has a top pan and by adjusting the load to be applied to this top pan, a contact pressure between the photosensitive element 601 and the intermediate transferring element 602 can be adjusted. In the holder 603, a load transducer 604 is further installed to detect a force, which is applied in a horizontal direction (in a left and right directions shown in FIG. 6)

perpendicularly to rotation axis of the photosensitive element 601 and the intermediate transferring element 602.

In addition, a noncontact type thermometer (not illustrated) is installed to monitor a temperature of a contact part of the photosensitive element and the intermediate transferring element. Furthermore, members such as a lubricant supply part and a cleaning roller, which are not illustrated, may be installed, if necessary.

The load transducer 604 is connected to an external apparatus such as an oscilloscope and a computer through a dynamic distortion amplifier. In the present experimental example, as a distortion amplifier, the dynamic distortion amplifier HEIDON 3K-84A (commercial name) made by Sintou Kagaku Corporation was used and as the load transducer 604, an apparatus obtained by modifying a dynamic distortion gauge, tribogear HEIDON 14 (commercial name) made by Sintou Kagaku Corporation was used.

Subsequently, a method for measuring friction by using this friction evaluation apparatus will be described below.

First, a weight is placed on the top pan of the holder 603 to load on and the contact pressure between the photosensitive element 601 and the intermediate transferring element 602 is adjusted. Next, by a driving system not illustrated, the photosensitive element 601 is rotated in a clockwise direction shown by an arrow in FIG. 6 in a predetermined speed for a certain time. In this case, the intermediate transferring element 602 is rotated counterclockwise as shown by an arrow in FIG. 6. According to these steps, for a time period from the start of rotation to the time when a steady speed state is reached, the forced applied is detected by the load transducer 604 and 704 to evaluate the frictional force.

FIG. 7 shows the friction evaluation apparatus located between the photosensitive element 701 and a image-transferring belt 702. To the photosensitive element 701 is contacted the image-transferring belt 702 with a predetermined length, which is circulatably held by the holder 703. As with to the friction evaluation apparatus shown in FIG. 6 located between a photosensitive element 601 and the intermediate transferring element 602, the holder 703 has the top pan to adjust the contact pressure between the photosensitive element 701 and the image-transferring belt 702, and the load transducer 704 to detect the frictional force. In addition, the configuration of the electrifier 705, exposing system 706, developing unit 707 and the like is same as with the friction evaluation apparatus shown in FIG. 6.

By using the friction evaluation apparatus shown in FIG. 7, as with the friction evaluation apparatus shown in FIG. 6, adjusting the contact pressure between the photosensitive element 701 and the image-transferring belt 702 allows for evaluating the frictional force created by the photosensitive element 701 and the image-transferring belt 702.

Figure 8A:
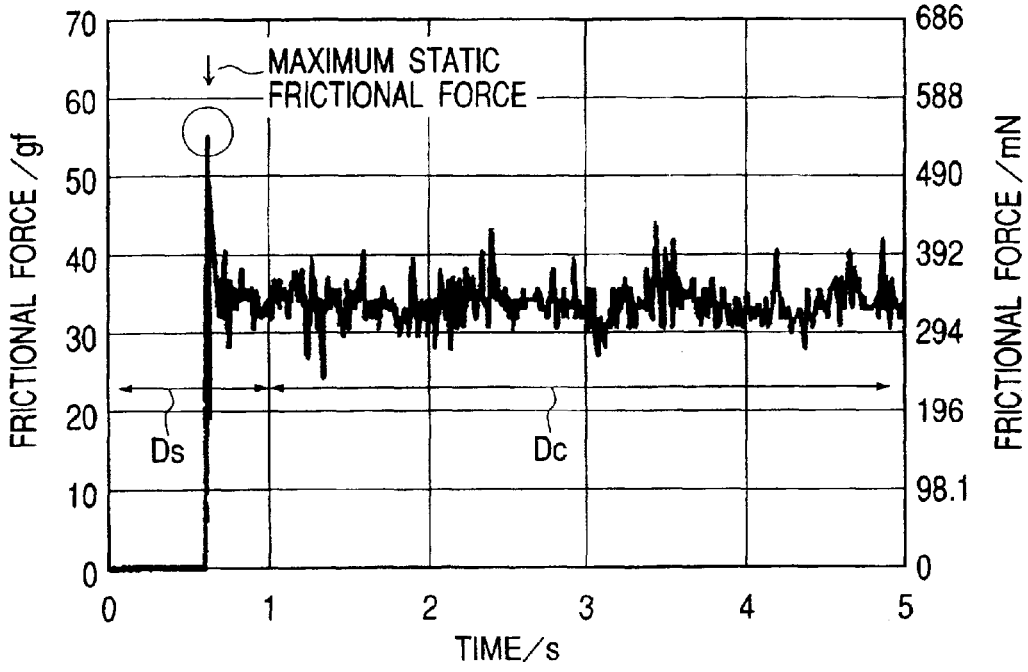
FIGS. 8A and 8B are graphs showing an example of friction evaluation.

Next, FIG. 8A shows an example of detecting the frictional force. As shown in FIG. 8A, when the photosensitive elements 601 and 701 are driven in a state where the intermediate transferring element 602 or the image-transferring belt 702 is contacted to the photosensitive elements 601 and 701 by applying a drag, namely, a load, the frictional force exhibits a maximum value immediately after start of driving. The frictional force at this instance is a maximum static frictional force. Thereafter, in the steady rotation state where the photosensitive elements 601 and 701 and the intermediate transferring element 602 or the image-transferring belt 702 are driven at a predetermined relative speed, the frictional force shows a substantially constant value. In FIG. 8A, the time of the steady rotation state and the time of start of driving therebefore are expressed by Dc and Ds, respectively. An average value of the frictional force at this time is referred to as a kinetic frictional force in this specification.

Depending on a surface condition of the photosensitive element 601 such as surface roughness of the photosensitive element 601 and a cleaning member not illustrated and agglutination of toner, in the steady rotation state, the frictional force does not always reach a constant value, but shows a small variation. As the value to evaluate the variation of the frictional force in the steady rotation state, in other words, the kinetic frictional force, a standard deviation was calculated and this value is referred to as a kinetic frictional force deviation in this specification.

Figure 8B:
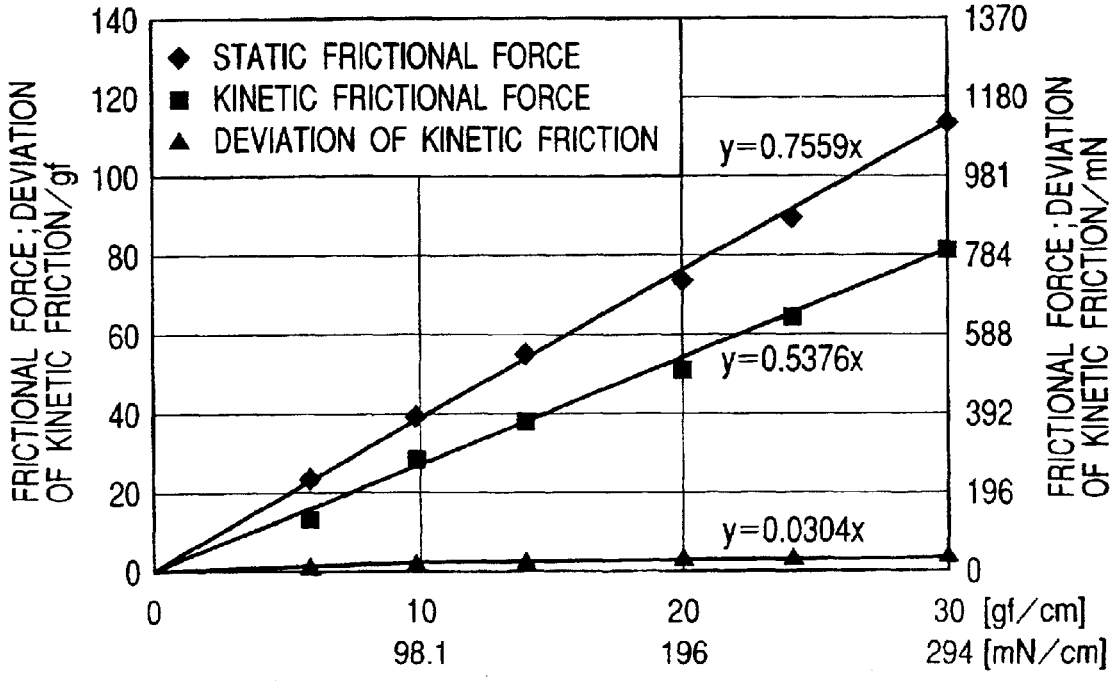

For the maximum static frictional force, the kinetic frictional force, and the kinetic frictional force deviation thus determined, the load placed on the top pan of the holder 603 and 703 was changed to change the contact pressure between the photosensitive elements 601 and 701 and the intermediate transferring element 602 or the image-transferring belt 702 and carried out measurement to determine the dependency on the contact pressure. A result thereof is shown by FIG. 8B. The horizontal axis of FIG. 8B shows the contact pressure for a unit length in a longitudinal direction of a contact face (hereafter, referred to as contact line pressure.)

As shown in FIG. 8B, the maximum static frictional force, the kinetic frictional force, and the kinetic frictional force deviation for the length of the contact part are substantially proportionate to the contact line pressure. In this case, proportion coefficients (corresponding to an inclination of a straight line of FIG. 8B) are referred to as a static frictional coefficient, a kinetic friction coefficient, and a kinetic friction deviation coefficient, respectively.

Here, the kinetic friction deviation means magnitude of variation of the frictional force in the contact part of the intermediate transferring element 602 or the image-transferring belt 702 to the photosensitive elements 601 and 701 and a small kinetic friction deviation means that in the contact part, shaking and capturing of the intermediate transferring element 602 or the image-transferring belt 702 do not take place and smooth sliding occurs. Further, the small kinetic friction deviation coefficient suppresses the kinetic friction deviation to not so large a value when the contact pressure is set to a certain high value, resulting in smooth sliding. In addition, the friction coefficient is one of characteristic values related to a transferring property, durability, and latitude of design.

The friction evaluation apparatus of FIGS. 6 and 7 are installed in a known environment-testing box or an environment-testing chamber, in which an internal environment can be controlled to a predetermined condition, an environment for installing the friction evaluation apparatus is set to a predetermined temperature and humidity, and then it was allowed to stand for 24 hours or more to make the condition of the photosensitive element and the cleaning member matched to the environment set. Then, as described above, by measuring the friction coefficient and the kinetic friction deviation coefficient, characteristics such as temperature dependency can be evaluated.

Hereafter, unless otherwise defined, the standard environment is set as 23° C. and 50 percent RH and temperature and humidity are changed as needed.

The form of the friction evaluation apparatus is not restricted to this experimental example, but any one can be used capable of conducting the above described measurement. For example, for testing the frictional force, a known piezoelectric device or distortion gauge may be used and also, for example, measurement may be conducted by using an apparatus incorporated in a known electrophotography apparatus.

Such friction evaluation experiment was repeatedly conducted together with fusion evaluation described later by using various kinds of the intermediate transferring element 602 and the image-transferring belt 702. As a result, the present inventors found that if the kinetic friction deviation, which is a value correlated with the magnitude of a small vibration occurring by repeatedly contacting the intermediate transferring element 602 or the image-transferring belt 702 to and detaching it from a surface of the photosensitive elements 601 and 701, falls within a range smaller than the kinetic frictional force, occurrence of fusion is suppressed. In addition, if the kinetic friction deviation coefficient is 0.1 or less, occurrence of fusion could be well suppressed.

Besides, as a result of experiment by changing an environmental temperature, in the case where the range of variation of the kinetic friction deviation coefficient is 0.02 or less when the temperature was changed from 15° C. to 60° C., occurrence of fusion could be better suppressed.

Further, in the case where an amorphous material such as a-SiC:H, a-C:H, and a-C:H:F, of which main component is silicon and/or carbon, is used as a material of a surface layer of the photosensitive elements 601 and 701 and variation of the friction coefficient falls within a range of 0.01 or less when the temperature was changed from 15° C. to 60° C., occurrence of fusion could be excellently suppressed.

EXPERIMENTAL EXAMPLE 2

(Characteristic Energy Eu of a Tail of an Exponential Function and Temperature Characteristic of Electrifiability of the Photosensitive Element.)

For an electric characteristic of the photosensitive element, it is preferable that a variation caused by the environmental change is small. Specifically, it is preferable that a change ratio of electriflability in change of a temperature (hereafter, temperature characteristic) falls in the range of ±2 V/° C. According to such condition, characteristics, of the photosensitive element, influencing on latent image formation and toner image formation become stable without a considerable effect of environment. And, by using the photosensitive element satisfying this condition, an image-forming apparatus capable of forming an image with a high quality stably and preferably can be constituted and a cleaning condition such as the state of toner left after transfer become stable.

On the other hand, the change of electrifiability causes the change of adhering force of toner to the surface of the photosensitive element and influences on characteristics of transfer of the toner image formed on the surface of the photosensitive element to a recording material held by the intermediate transferring element or the image-transferring belt. The present inventors found that concerning fusion in the contact part of the photosensitive element to the intermediate transferring element or the image-transferring belt, the influence of temperature dependency of electrifiability on the change of adhering force of toner to the surface of the photosensitive element cannot be ignored. This means that suppressing the change ratio of electrifiability in change of the temperature to small is preferable for suppressing fusion in the contact part of the photosensitive element to the intermediate transferring element or the image-transferring belt.

As a method for controlling temperature dependency of electrifiability, it is effective to control characteristic energy Eu of the tail of the exponential function (Urbach tail) of electrifiability of the photosensitive element.

As a rule, a subgap light absorption spectrum of a-Si is mainly divided into two parts: a part (tail of the exponential function or the Urbach tail) in which an optical absorbance coefficient $\alpha$ is exponential, namely, changeable substantially linearly, to photon energy $h\upsilon$, and the part, in which $\alpha$ shows moderate dependency to $h\upsilon$. A linear region of the former region corresponds to a region, where light absorption is observed in accordance with optical transition from a tail level in a valence band side in the a-Si to the level of conduction band, and exponential dependency of the absorbance coefficient $\alpha$ to $h\upsilon$ in the linear region is expressed by the following equation.

$$\alpha=\alpha_0 \exp(h\upsilon/Eu)$$

A logarithm of both sides of this equation is expressed by the following equation.

$$1n\alpha=(1/Eu)\cdot h\upsilon+\alpha_1$$

(where, $\alpha_1$ is $1n\alpha_0$).

Consequently, a reverse number of (1/Eu) of characteristic energy Eu expresses inclination of the linear region. Eu corresponds to characteristic energy of an exponential energy distribution of the tail level in the valence band side and therefore, a small Eu means a lower tail level in the valence band side.

As the method for measuring the state of localization level in such band gap, as a rule, deep level spectrophotometry, isothermal capacity transient spectrophotometry, photothermal polarization spectroscopy, photoacoustic spectroscopy, and constant photocurrent method are used. Among these, the constant photocurrent method (hereafter, CPM) is useful as the method for convenience measurement of the subgap light absorption spectrum on the basis of the localization level of a-Si:H. Measurement in the present experimental example was carried out by this CPM. CPM is the method for measurement of the energy level of a sample by irradiating a light of a predetermined wavelength changing a light quantity to make a photocurrent of a thin film sample constant.

In the present experimental example, for measuring characteristic energy Eu of the tail of the exponential function, the following photosensitive element was prepared for testing. By employing the above-described film-forming apparatus and the method comparable to a manufacturing method of the photosensitive element to be tested, an a-Si film sample with a film thickness of about 1 $\mu$m was deposited on a glass substrate (commercial name: 7059 made by Corning Inc.) and an Si wafer, which have been mounted on a cylindrical sample holder, under a condition of preparation of photoconductive layer. An Al comb electrode for measurement of characteristic energy Eu was vaporized on a deposit film sample formed on the glass substrate to prepare the photosensitive element to be tested. A test was carried out by using spectrophotometer SS-25GD (commercial name) made by Nippon Bunkou Corporation, current supply amplifier LI-76 (commercial name) made by NE Circuit Corp., and a lock-in made by the same corporation amplifier 5610B (commercial name).

On the other hand, as the image-forming apparatus of electrophotographic system for a temperature characteristic evaluation, an image-forming apparatus was user modified for electric characteristics evaluation by installing a modified electricpotential sensor for the surface of the photosensitive element housed in NP6750, made by Canon Inc. in the NP6750. Furthermore, a heater of a photosensitive element was modified to make the temperature of the photosensitive element variable and a noncontact thermometer was installed for preparation.

For the temperature characteristic, the electric potential (dark portion potential: Vd) of the surface of the photosensitive element under the condition lacking irradiation of rays for formation of the image was measured by changing the temperature of the surface of the photosensitive element from 15° C. to 50° C. This measurement was evaluated as electrifiability and the change ratio of electrifiability was measured for 1° C. temperature at this time. The result will be shown in FIG. 9.

Figure 9:
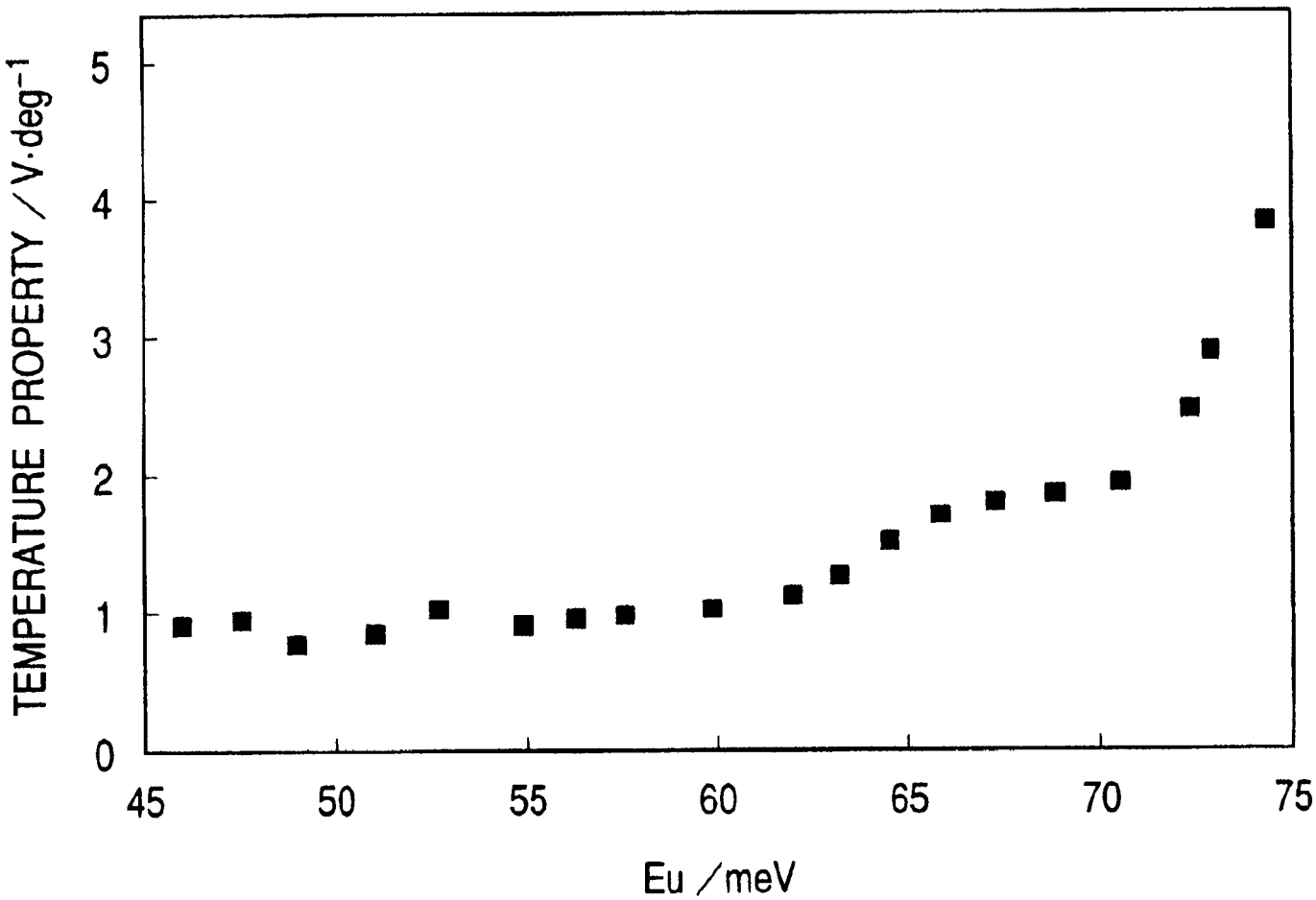
FIG. 9 is a graph showing dependency of temperature property on the characteristic energy.

From the result shown in FIG. 9, it was found that when Eu is 50 to 70 meV, the temperature characteristic can be improved to a better characteristic within ±2 V/° C. A range from 65 meV to lower is more preferable and in this case, the temperature characteristic can be made within ±1.5 V/° C. For reference, if the photosensitive element, of which EU is 50 meV or less, was prepared, a film-forming speed became slow to make film formation practically difficult and therefore, a lower limit of EU was set to 50 meV.

EXPERIMENTAL EXAMPLE 3

(Fusion)

Figure 10:
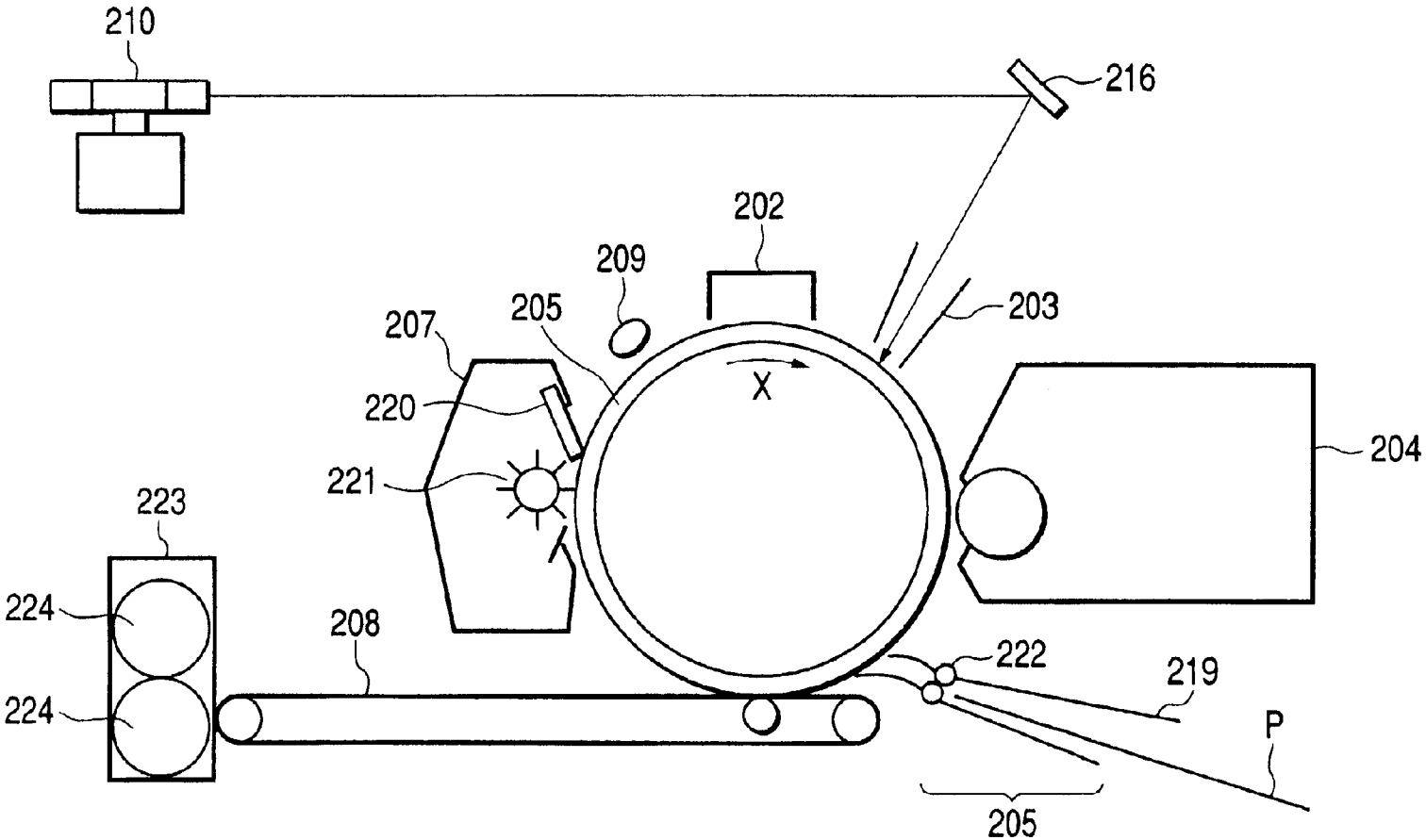
FIG. 10 shows schematically constitution of the image forming apparatus used for evaluation of melt adhesion.

FIG. 10 shows the image-forming apparatus of electrophotographic system used for text of fusion. In this image-forming apparatus, the image-transferring belt 208 is supported circulatably by contacting to a bottom face of the cylindrical a-Si photosensitive element 201.

Around the a-Si photosensitive element 201, a main electrifier 202, an image-exposing part 203 in which a laser light is irradiated on the photosensitive element from a laser optical system 210 through a returning mirror 216, and a developing unit 204 are installed. In addition, a cleaner 207, having a cleaning blade 220 and a cleaning brush 221, to remove toner left after transfer for an next step and charge releasing light irradiator 209 to release electric charges from the surface of the photosensitive element are installed. For the cleaning blade 220 and the cleaning brush 221, as a rule, an elastic member made of a thermoplastic resin is used.

In the one end part, namely, the rightward direction of FIG. 10, of a circulatory path of the image-transferring belt 208, a paper supply guide 219 to lead a recording material P and a paper supply system 205 having a resist roller 222 to supply the recording material P by adjusting supply timing for the image-transferring belt 208 are installed. In the other end part of the circulatory path of the image-transferring belt 208, a fixing device 223 having a fixing roller 224, which fixes a toner image to the recording material P followed by leading the recording material P to outside of the apparatus, is installed.

As described above, the image forming apparatus, by which the image is practically formable on the recording material P, is used, a toner is used which is made by Canon Inc., i.e., NP6750 toner, and a member of the image-transferring belt 208 used was various similar to the experimental example 1 including the transferring blade. As the photosensitive element, the photosensitive element prepared differs in the friction characteristics of the surface through adjusting a composition of material gases and discharging electric power.

By using such various image-transferring belts and photosensitive bodies, the contact pressure between the image-transferring belt 208 and the a-Si photosensitive element 201 was changed in a range from 0 (adjusting mechanisms opened) to 1500 g/cm$^2$ (147 kPa) and the image-forming apparatus was put in the environment-testing chamber, and the installing environment for the image-forming apparatus was put under a condition adjusted to a low temperature and low humidity environment (hereafter, "L/L environment") of 10° D. and 15 percent, respectively, a normal temperature and a normal humidity environment (hereafter, "N/N environment") of 23° C. and 50 percent, respectively, and a high temperature and high humidity environment (hereafter, "H/H environment") of 33° C. and 85 percent, respectively, in order to conduct a paper-passing duration test. Where, in the L/L environment and the N/N environment, a test was conducted by turning a photosensitive element heater to OFF and in the H/H environment, a test was conducted by turning the photosensitive element heater to OFF and also by turning the photosensitive element heater to ON accompanying with various temperatures for temperature-setting.

(Examination of Fusion)

A state (in this specification document, this state is named the state in which "fusion" occurred,) in which toner left after transfer was not removed from the surface of the photosensitive element in cleaning and collection stages, remains after repeating these stages, fixed to the surface of the photosensitive element, black line occurred on the image formed, was determined. This state was determined by observing the image and the surface of the photosensitive element on the basis of a determination standard presented in Table 1.

TABLE 1

| | Symbol | Determination standard |
|---|---|---|
| Very good | A | No fixing of toner to the surface of the photosensitive element. |
| Good | B | Toner fixed is 1.5 mm or less in diameter and three or fewer in number; no black line occurs. |
| No problem practically | C | There is toner, which has been fixed to the surface of the photosensitive element, matched the determination standard "good" or more superior; the black line caused by fixing is 1.5 mm or shorter in length and five or fewer in number. |
| There are some practical problems | D | According to fixing of toner to the surface of the photosensitive element, the black line occurred in a grade of and over the determination standard, "no problem practically." |

The result of examination of fusion will be shown in FIG. 2.

TABLE 2

| Photosensitive element | Contact pressure | | | | | | | | |
|---|---|---|---|---|---|---|---|---|---|
| | 1 g/cm$^2$ 98.1 Pa | 5 490 Pa | 20 1960 Pa | 50 4900 Pa | 100 9.81 kPa | 500 49 kPa | 1000 98.1 kPa | 1200 118 kPa | 1500 147 kPa |
| a-SiN surface layer | C | B | B | B | B | B | B | C | C |
| a-SiC surface layer | C | B | B | B | B | B | B | C | C |

TABLE 2-continued

| Photosensitive element | Contact pressure 1 g/cm² 98.1 Pa | 5 490 Pa | 20 1960 Pa | 50 4900 Pa | 100 9.81 kPa | 500 49 kPa | 1000 98.1 kPa | 1200 118 kPa | 1500 147 kPa |
|---|---|---|---|---|---|---|---|---|---|
| a-C:H surface layer | B | A | A | A | A | A | A | B | C |
| a-C:H:F surface layer | B | A | A | A | A | A | A | A | B |

Similar to this, Table 3 shows the result of the experiment by using the intermediate transferring element replacing to the image-transferring belt 208.

TABLE 3

| Photosensitive element | Contact pressure 1 g/cm² 98.1 Pa | 5 490 Pa | 20 1960 Pa | 50 4900 Pa | 100 9.81 kPa | 500 49 kPa | 1000 98.1 kPa | 1200 118 kPa | 1500 147 kPa |
|---|---|---|---|---|---|---|---|---|---|
| a-SiN surface layer | C | B | B | B | B | B | B | C | C |
| a-SiC surface layer | C | B | B | B | B | B | B | C | C |
| a-C:H surface layer | B | A | A | A | A | A | A | B | C |
| a-C:H:F surface layer | B | A | A | A | A | A | A | A | B |

As the result of the experiment, when the contact pressure between the image-transferring belt 208 and the a-Si photosensitive element 201 was assigned to a value smaller than 5 g/cm$^2$ (0.49 kPa,) a deficient contact pressure between the image-transferring belt 208 and the a-Si photosensitive element 201 caused considerably shaking of and the image-transferring belt 208 and this vibration transmitted to the cleaner 207 caused cleaning defect. On the other hand, the contact pressure was assigned to the value larger than 1000 g/cm$^2$ (98.1 kPa,) so-called "permanent set in fatigue" which is a phenomena causing fusion of toner, which was compressed by the a-Si photosensitive element 201 and the image-transferring belt 208, with the surface of the a-Si photosensitive element 201 and deformation of the image-transferring belt 208, occurred. Therefore, the contact pressure between the image-transferring belt 208 and the a-Si photosensitive element 201 is preferably in a range of 5 to 1000 g/cm$^2$ (0.49 to 98.1 kPa).

In this experimental example, the temperature of the contact part of the cleaning member to the a-Si photosensitive element 201 was almost 10° C. to 70° C.

As described above, as the elastic member used for cleaning by the cleaning blade 220 and the cleaning brush 221, as a rule, the thermoplastic resin is used. Therefore, under the condition of a low temperature, a hardness of the elastic member increases and an elastic repulsion force decreases. Thus, in the present experimental example, in case of the temperature of 15° C. or lower, during the paper-passing duration test, a chip occurred in the cleaning blade 220 and toner passed through the contact part of the cleaning member to cause occasionally a defect of cleaning.

In addition, in the case where the contact pressure between the image-transferring belt 208 and the a-Si photosensitive element 201 was changed higher from the above-described preferable range to make the friction force larger and where the temperature was set higher to work the photosensitive element heater, the temperature considerably rose occasionally. In the case where the temperature of the contact part of the cleaning member was 60° C. or higher, toner fixed occasionally to the surface of the photosensitive element and the cleaning member. In an excessively high temperature, toner fixes to the photosensitive element to make latitude for such occurrence as fusion appearing on the image narrow, to be not preferable.

As described above, when the temperature of the contact part of the cleaning member contacting to the a-Si photosensitive element 201 ranged from 15° C. to 60° C., good cleaning could be carried out. Consequently, the temperature of the contact part of the a-Si photosensitive element 201 to or the image-transferring belt 208 or the intermediate transferring element is preferably the range of 15° C. to 60° C. Further, for electrifiability of the a-Si photosensitive element as described in the experimental example 2, when the temperature falls in this range a preferable characteristic will be shown. Hence, also on the basis of this fact, the temperature of the contact part of the a-Si photosensitive element 201 to or the image-transferring belt 208 or the intermediate transferring element is preferably adjusted to this range.

EXPERIMENTAL EXAMPLE 4

(Structure of the Surface Layer)

The present inventors found that placing the surface layer mainly consisting of the amorphous material, particularly a-SiC:H, X or a-C:H, X having a high carbon content ratio, which has silicon and/or carbon as a main component, on the photosensitive element allows suppressing the vibration of chattering vibration generated in the contact part of the photosensitive element to the intermediate transferring element or the image-transferring belt and also allows preventing effectively fusion of toner with the surface of the photosensitive element. Particularly among them, using material a-C:H, X rich in lubricity for the surface layer allows achieving this effect effectively.

The following examination was carried out for a surface shape of the intermediate transferring element or the image-transferring belt and the photosensitive element. The surface of the photosensitive element before use and after being subjected to the paper-passing duration test was observed by using an AFM (atomic force microscope). As the result, it was found that a filming quantity differs particularly in a recessed part corresponding to an average inclination $\Delta a$ of the surface of the photosensitive element. In addition, a correlation was found between this filming quantity and occurrence of image flow. Thus, it was known that for suppressing formation of the filming film, adjusting the surface shapes of the intermediate transferring element or the image-transferring belt and the photosensitive element brings a splendid effect. By adjusting the surface shapes of the intermediate transferring element or the image-transferring belt and the photosensitive element, particularly in the image-forming apparatus having no photosensitive element heater, formation of the filming film can be suppressed and thus, image flow can be also prevented.

In U.S. Pat. No. 5,701,560 specification (Hitachi Kouki, K.K.,) it has been disclosed that for the a-Si photosensitive element, adjustment of surface roughness improves cleaning performance and a restricted effect has been disclosed.

For the photosensitive element having the a-SiC:H surface layer, by using the photosensitive element, in which the surface roughness Ra of the center line and the average inclination Δa have been changed, fusion evaluation was conducted. The result will be shown in Table 4. In Table 4, evaluation was carried out on the standard similar to the evaluation standard shown in Table 1 of the experiment 3.

TABLE 4

| | Ra | | | | | | | |
|---|---|---|---|---|---|---|---|---|
| Δa | 0.005 | 0.01 | 0.03 | 0.06 | 0.10 | 0.30 | 0.9 | 1.2 |
| 0.001 | C | B | B | B | B | B | B | C |
| 0.01 | C | B | B | B | B | B | B | C |
| 0.03 | C | B | B | B | B | B | B | C |
| 0.06 | C | B | B | B | B | B | B | C |
| 0.10 | C | C | C | C | C | C | C | C |

On the a-Si photosensitive element, it has been known that an abnormally-grown projection part, which has a diameter ranging from several micrometers to several hundred micrometers and a height ranging from several micrometers to several ten micrometers and formed around a nucleus being injury of and dust on a substrate in film formation, is formed. Such projection is a big one having a different size than typical one in evaluation of the roughness Ra of a center line and the average inclination Δa. Filming and fusion occasionally occur because of this projection. Then, by a photosensitive element surface treatment method disclosed in the specification of Japanese Patent No. 2047474 (Japanese Patent Publication No. 07-077702) a treatment for reducing the height of the abnormally-grown projection. As a result, concerning filming and fusion caused by such projection, it has been known that when the height of the projection is the same as the or less than a particle size of toner, specifically, 5 μm or less, they do merely occur. This may be because influenced by high surface hardness of the a-Si photosensitive element, a part captured by the intermediate transferring element or the image-transferring belt becomes small and occurrence of injury is suppressed and hence, small vibration and fusion caused by this small vibration are prevented.

The result of fusion evaluation using the photosensitive element in which the height of the abnormally-grown projection was adjusted to 5 μm or less by grinding process will be shown in Table 5.

TABLE 5

| | Ra | | | | | | | |
|---|---|---|---|---|---|---|---|---|
| Δa | 0.005 | 0.01 | 0.03 | 0.06 | 0.10 | 0.30 | 0.9 | 1.2 |
| 0.001 | C | B | B | B | B | B | B | B |
| 0.01 | C | A | A | A | A | A | B | C |
| 0.03 | C | A | A | A | A | A | B | C |
| 0.06 | C | A | A | A | A | A | B | C |
| 0.10 | C | C | C | C | C | C | C | C |

From results of Tables 4 and 5, it was known that making the average roughness Ra of the center line of the surface of the a-Si photosensitive element to 0.01 μm to 0.9 μm and the average inclination Δa to 0.001 to 0.06 allows prevention of fusion preferably. In addition, making the height of the abnormally-grown projection to 5 μm or less allows prevention of fusion more preferably.

As described above, the present inventors found that adjusting the kinetic friction deviation correlated with magnitude of the vibration of chattering vibration, which is generated by contact of the intermediate transferring element or the image-transferring belt to the a-Si photosensitive element, to a specific range can prevent transfer shift caused by vibration, prevent a change of the contact part to a high temperature and high humidity by vibration energy, and prevent fusion of toner with the photosensitive element and occurrence of image flow. In addition, by preparing the surface layer mainly composed of the amorphous body, which is mainly consisting of silicon and/or carbon, on the surface of the a-Si photosensitive element, designating the surface shape preferably, limiting the change ratio of electrifiability of the photosensitive element to a specific range, and limiting the contact pressure between the photosensitive element and the intermediate transferring element or the image-transferring belt to the specific range, the inventors found that vibration of the contact part of the photosensitive element to the intermediate transferring element or the image-transferring belt can be suppressed and fusion of toner with and attachment of an exogenous matter to the surface of the photosensitive element can be prevented, and occurrence of image flow can be also prevented.

A digital image-forming method of the electrophotographic apparatus is mainly classified into two systems based on relation between image information and the exposing part. The one is an image exposing method (hereafter, IAE), by which the image part being the part having a pixel formed is exposed, and the other is a background exposing method (hereafter, BAE) by which non-image part (background part) being the part without any pixel formed is exposed.

BAE is an identical method to an analog image-forming method of the electrophotographic apparatus and has advantages that the image can be formed as normal development by using a developing mechanisms, a cleaning mechanisms, and a developing unit, which are common to an analog electrophotographic apparatus. On the other hand, IAE requires reversal development by using the developing unit of a reverse polarity.

Transferring and separating ability for separating an image, formed by toner, from the surface of the photosensitive element to transfer to the recording material and an intermediate transferring material is considerably influenced by such latitudes as a transfer efficiency and separation, a transferring voltage in retransfer. In IAE, the electric potential in the non-image part is higher than the electric potential in the image part and therefore, transfer is difficult. Thus, BAE is easy to carry out transfer in comparison with IAE.

In cleaning operation, due to attenuated potential of the photosensitive element, in IAE, which is a system to develop in the part with a low potential, the developing unit is easy to attach to the surface of the photosensitive element in a cleaning site. Therefore, the cleaning latitude of BAE is wider than that of IAE. Then, in the image-forming apparatus of the present invention, employing BAE as an exposure system and performing image formation by normal development allow the latitude of cleaning wider.

Next, on the image-forming apparatus satisfying the above-described preferred conditions resulting from the above-described experimental examples, further specific examples will be described.

EXAMPLE 1

In the present example, as shown in FIG. 1, examples of the image-forming apparatus configured having the intermediate transferring element will be shown.

First, the method for configuring the intermediate transferring element will be described. On the surface of an aluminium-made cylindrical roller with a size of a diameter of 182 mm, a length of 320 mm, and a thickness of 5 mm, a rubber compound of compound shown in Table 6 is subjected to cross-head extrusion molding by using a mold and the surface layer was ground to form an elastic layer. For reference, in Table 6, a mixing proportion has been shown in a mass proportion based on content of 100 parts of NBR.

TABLE 6

| Formation | Compounding ratio |
|---|---|
| NBR (Nitrile rubber) | 100 parts |
| Zinc oxide | 2 parts |
| Electroconductive carbon black | 10 parts |
| Paraffinic oil | 30 parts |
| Vulcanizer | 2 parts |
| Vulcanization accelerator | 3 parts |

A coat having the formulation shown in Table 7 was applied by spraying to the outer periphery of the roller to form a coating layer having a thickness of 80 μm, then the coating layer was heated for an hour at 90° C. to remove the remaining solvent and cause bridging in the film to obtain an intermediate transferring element having a tough surface layer. In addition, in Table 7, the mixing proportion has been shown in a mass proportion based on content of 100 parts of polyester polyurethane prepolymer.

TABLE 7

| Formation | Compounding ratio |
|---|---|
| Polyester polyurethane prepolymer (Containing a solvent) | 100 parts (solids 40 mass percent) |
| Hardner (containing a solvent) | 50 parts (solids 60 mass percent) |
| Highly lubricant powder PTFE particles (particle size 0.3 μm) | 200 parts |
| Dispersion aid (a low molecular weight resin) | 5 parts |
| Conductive titanium oxide particle (particle size 0.5 μm) | 10 parts |
| Toluene (solvent) | 80 parts |

After hardening of a coat, the proportion (weight proportion) of PTFE particles contained in all constituent components of the surface layer of the intermediate transferring element was about 70 percent. The intermediate transferring element was put on an aluminium plate with the size of 350 mm×200 mm contacting a transferring plane thereof under the condition of 23° C. temperature and 65 percent humidity environment, A voltage of 1 kV was applied by connecting a high voltage electric wire across an aluminium cylinder and the aluminium plate of an inside face of the intermediate transferring element through a 1 kQ resistance to measure the electric potential difference between before and after the resistant body followed by conversion to an electric current value to yield a volume resistivity of the intermediate transferring element from these values of voltage and electric current applied. The volume resistivity was $5.0\times10^7$ ω.

As the photosensitive element, a 62ϕ aluminium cylinder was used as a base body and the a-Si photosensitive element having the a-SiC surface layer was also used. Morphology of the surface of the photosensitive element was prepared to have the average roughness Ra 0.21 μm of the center line and the average inclination Δa of 0.02.

As the intermediate transferring element cleaner, a medium resistant roller, which has an top layer made of urethane rubber, in which conductive carbon was dispersed, and a covering layer, in which conductive tin oxide was dispersed in methoxymethylated nylon, and has the resistance of about 108 ω·cm, was used and cleaning was carried out by applying a biased voltage of +2.0 kV to this medium resistant roller.

For preparation of the latent image, laser exposure was carried out by BAE on the a-Si photosensitive element in a 600 dpi (dot per inch) resolution to form the static latent image of the dark portion potential VD=450 V and light potential VL=50 V.

Next, a distance (S-D distance) between a photosensitive element drum and a development sleeve was adjusted to 300 μm and a developing magnetic pole was adjusted to 80 mT (800 G). As a toner regulating member, a urethane rubber-made blade with the thickness of 1.0 mm and a free length of 10 mm was contacted by a contacting linear pressure of 147 N/m (15 g/cm). As the bias for development, the voltage of a direct current bias component Vdc=−450 V, a convolutional alternating current bias component Vp−p=1200 V, and f=2000 Hz was applied. As toner, magnetic toner was used.

As the photosensitive element cleaner, a urethane rubber-made cleaning blade with the thickness of 2.0 mm and a free length of 8 mm was used and this cleaning blade was contacted by a contacting linear pressure of 24.5 N/m (25 g/cm) to carry out cleaning. In addition, a processing speed was set to 94 mm/sec and the developing sleeve was rotated in a circumferential velocity of a ratio Vt/V (circumferential velocity Vt of the developing sleeve to circumferential velocity V of the photosensitive element)=1.5 in a normal direction.

Under the above-described conditions, image forming was carried out and a transfer efficiency, an image quality, and durability for repetition of copying were tested and confirmed.

A primary transfer efficiency from the photosensitive element drum being a first image carrier to the intermediate transferring element was 96.5 percent and a secondary transfer efficiency from the intermediate transferring element to paper, of which unit area weight is 80 g/cm2, being a second image carrier was 97 percent. For reference, in the present specification, the primary transfer efficiency and the secondary transfer efficiency are values calculated by the following equations.

Primary transfer efficiency=density on intermediate transferring element/(density of toner left after transfer on photosensitive element+density on intermediate transferring element)×100 (%)

Secondary transfer efficiency=density on paper/(density on intermediate transferring element+density on paper)×100 (%)

When the image forming test was repeatedly carried out, a voided character was not generated, a fine line could be outputted with a good quality, and for a filled image, an the image with an even quality was yielded. After a duration test by passing ten thousands sheets of paper, the good quality image similar to an initial stage was yielded and the secondary transfer efficiency was 95 percent and showed almost no deterioration. A microscopic observation of the surface of the intermediate transferring element after the duration test by passing twenty thousands sheets of paper almost merely showed occurrence of filming of toner yielding a good result.

EXAMPLE 2

In the present example, as shown in FIG. 2, examples of the image-forming apparatus configured having the image-transferring belt similar to that of FIG. 2 will be shown.

As the photosensitive element, the aluminum cylinder with the 62 mm diameter and the thickness of about 3 mm was used as a base body and the a-Si photosensitive element having the a-C surface layer was also used. Morphology of the surface of the photosensitive element was prepared to have the average roughness Ra 0.03 $\mu$m of the center line and the average inclination $\Delta a$ of 0.03. On the surface of the photosensitive element, a light emission diode to emit a light mainly composed of a 700 nm peak wavelength was used to do pre-exposure and image exposure was carried out by using a semiconductor laser having a 680 nm peak wavelength to form a static latent image. As the image-transferring belt, one made from the material same as that of the Example 1 was used.

Under the condition described above, the duration test was conducted by passing twenty thousands sheets of paper. The microscopic observation of the surface of the image-transferring belt after the duration test almost merely showed occurrence of filming of toner yielding a good result.

EXAMPLE 3

Figure 11:
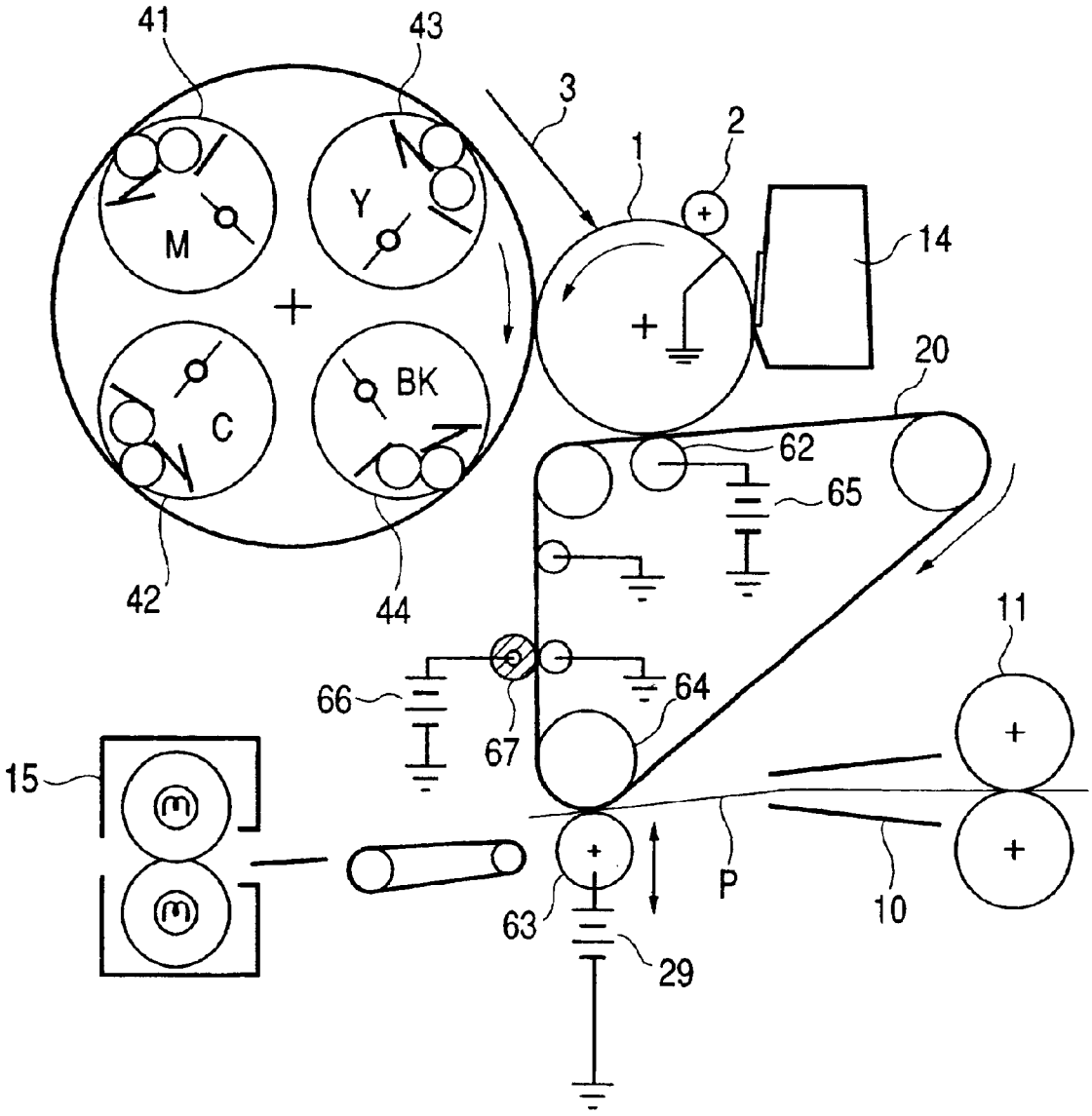
FIG. 11 is a schematic drawing for explaining an example of the image forming apparatus having a belt-shaped intermediate image-transfer element.

In the present example, as shown in FIG. 11, the image-forming apparatus, which was configured having the intermediate transferring element (an intermediate image-transferring belt) on the image-transferring belt, was used.

The apparatus shown in FIG. 11 is a color image-forming apparatus (a copying machine or a laser beam printer) employing an electrophotographic process. For the intermediate image-transferring belt 20, the elastic body with the medium resistance was used.

Reference numeral 1 denotes a rotative drum-type electrophotographic photosensitive element (hereafter, photosensitive drum) repeatedly used as a first image carrier and rotatively driven in the predetermined circumferential velocity (processing speed) in a clockwise direction shown by an arrow.

The photosensitive drum 1 is rotatively driven in the predetermined circumferential velocity (processing speed) and during rotation process, subjected to electrifying processing evenly to make a polarity and the potential predetermined by a primary electrifier 2. Subsequently, image exposure processing by image exposure means 3 (color separation and imaging exposure optical systems for a color manuscript image and a scanning exposure system using a laser scanner to output a laser beam, which is modulated corresponding to a time sequence electric digital pixel signal of the image information) not illustrated forms the static latent image corresponding to a first color component image (for example, a yellow color component image) of an objective color image.

Next, the static latent image is developed by yellow toner Y, a first color, by the first developing unit (a yellow color developing unit 43). At this time, each developing unit of a second to a fourth developing units (magenta color developing unit 41, cyan color developing unit 42, and black color developing unit 44) have been turned operation-OFF and does not work on a photosensitive drum 1 and thus, a yellow toner image of the above described first color is not influenced by the above described the second to the fourth developing units.

The intermediate image-transferring belt 20 is rotatively driven in the predetermined circumferential velocity (a circumferential velocity the same as that of the photosensitive drum 1) in the clockwise direction.

Yellow toner image of the above-described first color formed and borne on the photosensitive drum 1, during the process in which it passes through a nip part of the photosensitive drum 1 and the intermediate image-transferring belt 20, by an electric field formed by a primary transfer bias, which is applied from a primary transfer roller 62 to the intermediate image-transferring belt 20, is sequentially and intermediately transferred (primarily transferred) to an outer circumferential face.

The surface of the photosensitive drum 1, which completed transfer of yellow toner image of the first color corresponding to the intermediate image-transferring belt 20, is cleaned by a cleaning apparatus 14.

In the following section, similarly, a magenta toner image of a second color, a cyan toner image of a third color, and a black toner image of a fourth color are serially transferred to the intermediate image-transferring belt 20 by layering to form a synthesized color toner image corresponding to the objective color image.

The reference numeral 63 is a secondary transferring roller born in parallel with an opposite roller 64 for a secondary transfer and installed on a bottom face part of the intermediate image-transferring belt 20 in a separable state.

The primary transferring bias voltage for sequential layering transfer of the first to the fourth color toner images from the photosensitive drum 1 to the intermediate image-transferring belt 20 is applied from a bias power supply 65 in the reverse polarity (+) to toner. The voltage applied ranges, for example, from +100 V to 2 kV.

During the primary transferring process of the toner images of the first to the third color from the photosensitive drum 1 to the intermediate image-transferring belt 20, the secondary transferring roller 63 can be separated from the intermediate image-transferring belt 20.

In transfer of the synthesized color toner image, which is transferred to the intermediate image-transferring belt 20, to the transferring material P being a second image bearer, the secondary transferring roller 63 is contacted to the intermediate image-transferring belt 20, the transferring material P is supplied from the paper feeding roller 11 through a transferring material guide 10 to the contact nip of the intermediate image-transferring belt 20 and the secondary transferring roller 63 in a predetermined timing, and a secondary transferring bias is applied from a power supply 28 to the secondary transferring roller 63. By this secondary transferring bias, the synthesized color toner image is transferred (secondarily transferred) from the intermediate image-transferring belt 20 to the transferring material P. The transferring material P subjected to transfer of the toner image is led to the fixing device 15 to fix by heating.

After completion of image transfer to the transferring material P, the electrifying member 67 for cleaning is contacted to the intermediate image-transferring belt 20 and by applying the bias voltage of the polarity reversed to the photosensitive drum 1, toner (toner left after transfer), which has not transferred to the transferring material P but left on the intermediate image-transferring belt 20, is electrically charged in the polarity reversed to the photosensitive drum 1. The reference numeral 66 denotes the bias power supply.

The above-described toner left after transfer is statically transferred to the photosensitive drum 1 in the nip part of and around the photosensitive drum 1 and hence, the intermediate image-transferring belt is cleaned.

Such use of the intermediate image-transferring belt is very preferable for extending options of the image bearer being a recording medium such as paper.

In the present example, by using the apparatus of such configuration, image formation was carried out by the following manner.

For reference, the electric resistance of the intermediate image-transferring belt used was $1.8\times10^{10}$ ω.

In addition, on the contact face of the photosensitive drum 1 to the intermediate image-transferring belt (the same in case of the above-described cylindrical intermediate transferring element and image-transferring belt,) as described above, respective parts are rotatively driven in the same circumferential velocity, as a rule, in the same direction.

However, with a purpose to improve transfer efficiency and the like, in the range not badly influencing image formation, a previously-determined small relative speed difference in the above-described circumferential velocity, in other words, a small difference in circumferential velocity, may be set.

Needless to say, similar to case of the cylindrical intermediate transferring element and the image-transferring belt, a very small speed variation caused by variability and shift of rotative drive can be regarded as a constant relative speed.

In the present example, as the photosensitive element, the aluminum cylinder with the 80 mm diameter and the thickness of about 3 mm was used as the base body and the a-Si photosensitive element, negatively charged, having amorphous silicon as an optically conductive layer and the nonmonocrystal carbon (a-C, amorphous carbon) as the surface layer was also used.

Morphology of the surface of the photosensitive element was prepared to have the average roughness Ra=0.04 μm of the center line, the average inclination of Δa=0.04, a 660 nm light source (not illustrated) for pre-exposure, and the 655 nm semiconductor laser as the light source.

Under the above-described conditions, similar to the Example 1 and the Example 2, the duration test was conducted by passing twenty thousands A4 sized sheets of paper by adjusting to meet the range of the present invention and then, the microscopic observation of the surface of the intermediate image-transferring belt merely showed occurrence of filming of toner yielding a stabilized output of the image.

As described above, according to the present invention, chattering vibration can be prevented, image flow caused by incorrect transfer, toner fused with the surface of the photosensitive element, and attachment of paper powder can be prevented, and the high quality image can be formed.

Because chattering vibration can be prevented, deterioration, of the intermediate transferring element and the image-transferring belt, caused by chattering vibration can be prevented. Therefore, a life of these members can be prolonged. In addition, deterioration caused by chattering vibration can be prevented and therefore, using the image-transferring belt and the intermediate transferring element, which comprise various materials and configurations, becomes possible and also these members can be driven in a higher speed.

Furthermore according to the present invention, unless heating the photosensitive element by the heater, fusion of toner with the photosensitive element and attachment of the exogenous matter such as paper powder can be prevented and thus, without deterioration of quality of the image formed, heating stage of the photosensitive element using the heater is omitted to reduce an electric supply power in a dormant state.

What is claimed is:

1. An image-forming process for use in an electrophotographic system employing an image forming apparatus equipped with a photosensitive member including a photoconductive layer composed of a silicon-based non-monocrystalline material and a surface layer composed of a non-monocrystalline material formed in the foregoing order on a peripheral surface of a cylindrical electroconductive substrate, and a cylindrical intermediate image-transfer element in contact with the surface layer, and rotating the photosensitive member and the intermediate image-transfer element at a prescribed relative speed, said image-forming process comprising:

an electrifying step of electrifying the surface layer;

a latent image-forming step of forming an electrostatic latent image by projection of light onto the electrified surface layer;

a developing step for forming a toner image by providing a toner on the electrified surface layer bearing the electrostatic latent image;

an image-transferring step for transferring the toner image onto the intermediate image-transfer element;

repeating said electrifying step, said latent image-forming step, said developing step, and said transferring step a plurality of times to form a plurality of toner images in superposition on the intermediate image-transfer element; and a transferring step of transferring the toner images formed in superposition on the intermediate image-transfer element onto a recording sheet, wherein the photosensitive member and the intermediate image-transfer element are brought into contact at a contact temperature in a range of 15° C. to 60° C. at the prescribed relative speed to achieve a kinetic frictional force deviation (a standard deviation of a kinetic frictional force), which is less than an average value of the kinetic frictional force.

2. The image-forming process according to claim 1, wherein a kinetic frictional deviation coefficient is not higher than 0.1, where the kinetic frictional deviation coefficient is a rate of change of the kinetic frictional force deviation per unit length in a length direction along the contact between the photosensitive member and the intermediate image-transfer element with a contacting linear pressure, and wherein the contacting linear pressure is defined as being a force applied to contact the photosensitive member with the intermediate image-transfer element per unit length in the length direction.

3. The image-forming process according to claim 2, wherein a range of a variation of the kinetic frictional force deviation coefficient is not more than 0.02 for a change in the contact temperature in the range of 15° C. to 60° C.

4. The image-forming process according to claim 2, wherein the surface layer of the photosensitive member is composed of a non-monocrystalline material including at least one of silicon atoms and carbon atoms, and wherein a range of a variation of the kinetic frictional deviation coefficient is not more than 0.01 for a change in the contact temperature in the range of 15° C. to 60° C.

5. The image-forming process according to claim 1, wherein a ratio of a change of a dark portion electrifiability to a change of temperature of the surface layer is within ±2%/° C.

6. The image-forming process according to claim 5, wherein a characteristic energy of a tail of a valence band in an exponential energy distribution is in a range of 50 to 70 meV.

7. The image-forming process according to claim 1, wherein a center-line average roughness Ra of the surface layer is in a range of 0.01 to 0.9 μm, and wherein an average inclination Δa of a roughness curve f(x) is in a range of 0.001 to 0.06, as defined by the following equation:

$$\Delta a = \frac{1}{l}\int_0^l \left|\frac{dy}{dx}\right| dx,$$

where y is a height in a Y direction at a point of the curve extending a distance x in an X direction, and l is a length of the curve.

8. The image-forming process according to claim 1, wherein the intermediate image transfer element is a roller.

9. An image-forming process for an electrophotographic system employing an image-forming apparatus equipped with a plurality of photosensitive members, each of the plurality of photosensitive members including a photoconductive layer composed of a silicon-based non-monocrystalline material and a surface layer composed of a non-monocrystalline material formed in the foregoing order on a peripheral face of a cylindrical electroconductive substrate, and an image-transferring belt for holding and delivering a recording sheet with successive contact, respectively, with the plurality of photosensitive members, and moving the plurality of photosensitive members and the recording sheet at a prescribed relative speed, the image-forming process comprising:

an electrifying step of electrifying the surface layer of one of the plurality of photosensitive members;

a latent image-forming step of forming an electrostatic latent image by projection of light onto the electrified surface layer, a developing step for forming a toner image by providing a toner on the electrified surface layer bearing the electrostatic latent image;

an image-transferring step for transferring the toner image onto the recording sheet; and repeating said electrifying step, said latent image-forming step, said developing step, and said image-transferring step to form a plurality of toner images in superposition on the recording sheet, wherein the plurality of photosensitive members, respectively, and the recording sheet are brought into contact at a contact temperature in a range of 15° C. to 60° C. at the prescribed relative speed to achieve a kinetic frictional force deviation (a standard deviation of a kinetic frictional force), which is less than an average value of the kinetic frictional force.

10. The image-forming process according to claim 9, wherein a kinetic frictional deviation coefficient is not higher than 0.1, where a kinetic frictional deviation coefficient is a rate of a change of a ratio of the kinetic frictional force deviation per unit length in a length direction along the contact between the plurality of photosensitive members and the recording sheet with a contacting linear pressure, wherein the contacting linear pressure is defined as being a force applied to contact each of the plurality of photosensitive members with the recording sheet per unit length in the length direction.

11. The image-forming process according to claim 10, wherein a range of variation of the kinetic frictional force deviation coefficient is not more than 0.02 for a change in the contact temperature in the range of 15° C. to 60° C.

12. The image-forming process according to claim 10, wherein the surface layer of the photosensitive member is composed of a non-monocrystalline material including at least one of silicon atoms and carbon atoms, and wherein a range of a variation of the kinetic frictional deviation coefficient is not more than 0.01 for a change in the contact temperature in the range of 15° C. to 60° C.

13. The image-forming process according to claim 9, wherein a ratio of change of a dark portion electrifiability to a change in temperature of the surface layer is within ±2%/° C.

14. The image-fanning process according to claim 13, wherein a characteristic energy of a tail of a valence band in an exponential energy distribution is in a range of 50 to 70 meV.

15. The image-forming process according to claim 9, wherein an average roughness Ra of a center line of the surface layer is in a range of 0.01 to 0.9 μm, and wherein an average inclination Δa of a roughness curve f(x) is in a range of 0.001 to 0.06, as defined by the following equation:

$$\Delta a = \frac{1}{l}\int_0^l \left|\frac{dy}{dx}\right| dx,$$

where y is a height in a Y direction at a point of a curve extending a distance x in an X direction, and l is a length of the curve.

16. An image-forming process for use in an electrophotographic system employing an image forming apparatus equipped with a photosensitive member including a photoconductive layer composed of a silicon-based non-monocrystalline material and a surface layer composed of a non-monocrystalline material formed in the foregoing order on a peripheral surface of a cylindrical electroconductive substrate, and an intermediate image-transfer element in contact with the surface layer, and rotating the photosensitive member and the intermediate image-transfer element at a prescribed relative speed, said image-forming process comprising:

an electrifying step of electrifying the surface layer;

a latent image-forming step of forming an electrostatic latent image by projection of light onto the electrified surface layer;

a developing step for forming a toner image by providing a toner on the electrified surface layer bearing the electrostatic latent image;

an image-transferring step for transferring the toner image onto the intermediate image-transfer element;

repeating said electrifying step, said latent image-forming step, said developing step, and said transferring step a plurality of times to form a plurality of toner images in superposition on the intermediate image-transfer element; and a transferring step of transferring the toner images formed in superposition on the intermediate image-transfer element onto a recording sheet, wherein the photosensitive member and the intermediate image-transfer element are brought into contact and at a contact temperature in a range of 15° C. to 60° C. at the prescribed relative speed to achieve a kinetic frictional force deviation (a standard deviation of a kinetic frictional force), which is less than an average value of the kinetic frictional force.

17. The image-forming process according to claim 16, wherein the intermediate image-transfer element comprises a belt.

18. The image-forming process according to claim 16, wherein a kinetic frictional deviation coefficient is not higher than 0.1, where the kinetic frictional deviation coefficient is a rate of change of the kinetic frictional force deviation per unit length in a length direction along the contact between the photosensitive member and the intermediate image-transfer element with a contacting linear pressure, and wherein the contacting linear pressure is defined as a force applied to contact the photosensitive member with the intermediate image-transfer element per unit length in the length direction.

19. The image-forming process according to claim 18, wherein a range of a variation of the kinetic frictional force deviation coefficient is not more than 0.02 for a change in the contact temperature in the range of 15° C. to 60° C.

20. The image-forming process according to claim 18, wherein the surface layer of the photosensitive member is composed of a non-monocrystalline material including at least one of silicon atoms and carbon atoms, and wherein a range of a variation of the kinetic frictional deviation coefficient is not more than 0.01 for a change in the contact temperature in the range of 15° C. to 60° C.

21. The image-forming process according to claim 16, wherein a ratio of a change of a dark portion electrifiability to a change of temperature of the surface layer is within ±2%/° C.

22. The image-forming process according to claim 21, wherein a characteristic energy of a tail of a valence band in an exponential energy distribution is in a range of 50 to 70 meV.

23. The image-forming process according to claim 16 wherein a center-line average roughness Ra of the surface layer is in a range of 0.01 to 0.9 μm, and wherein an average inclination Δa of a roughness curve f(x) is in a range of 0.001 to 0.06, as defined by the following equation:

$$\Delta a = \frac{1}{l}\int_0^l \left|\frac{dy}{dx}\right| dx,$$

where y is a height in a Y direction at a point of the curve extending a distance x in an X direction, and l is a length of the curve.

* * * * *

UNITED STATES PATENT AND TRADEMARK OFFICE

CERTIFICATE OF CORRECTION

PATENT NO. : 6,764,800 B2
DATED : July 20, 2004
INVENTOR(S) : Koji Yamazaki et al.

It is certified that error appears in the above-identified patent and that said Letters Patent is hereby corrected as shown below:

Title page,
Item [56], References Cited, U.S. PATENT DOCUMENTS, please insert:

-- 5,342,784 8/1994 Yamada, et al.
5,837,345 11/1998 Nishino, et al. --.

FOREIGN PATENT DOCUMENTS, "5045916" should read -- 5-045916 --.

Column 4,
Line 55, after "speed;" (close up the vertical space).

Column 5,
Line 11, after "force." (close up the vertical space): and
Line 38, "contact-" should read -- contact --.

Column 6,
Lines 5 and 8, "roughness" should read -- roughness according to JIS --;
Lines 31 and 36, "fanning" should read -- forming --;
Line 37, "fanned" should read -- formed --; and
Line 39, "farming" should read -- forming --.

Column 8,
Line 17, "uniformly" should read -- uniformity --; and
Line 31, "fanned" should read -- formed --;
Line 51, "other" should be deleted.

Column 12,
Line 50, "tope" should read -- top --.

Column 14,
Line 12, "invention" should read -- invention is the same as that defined in JIS B0601-1994, and --.

Column 31,
Line 30, "layer," should read -- layer; --.

UNITED STATES PATENT AND TRADEMARK OFFICE

CERTIFICATE OF CORRECTION

PATENT NO. : 6,764,800 B2
DATED : July 20, 2004
INVENTOR(S) : Koji Yamazaki et al.

It is certified that error appears in the above-identified patent and that said Letters Patent is hereby corrected as shown below:

Column 32,
Line 4, “fanning” should read -- forming --; and
Line 51, “and” should be deleted.

Column 34,
Line 4, “16” should read -- 16, --.

Signed and Sealed this

Seventh Day of December, 2004

JON W. DUDAS
*Director of the United States Patent and Trademark Office*